US006971549B2

(12) United States Patent
Leifheit et al.

(10) Patent No.: US 6,971,549 B2
(45) Date of Patent: Dec. 6, 2005

(54) BOTTLE ADAPTER FOR DISPENSING OF CLEANSER FROM BOTTLE USED IN AN AUTOMATED CLEANSING SPRAYER

(75) Inventors: David H. Leifheit, Racine, WI (US); Terry M. Kovara, Racine, WI (US); Peter M. Neumann, Racine, WI (US); Amber N. D. Mazooji, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 178 days.

(21) Appl. No.: 10/418,793

(22) Filed: Apr. 18, 2003

(65) Prior Publication Data

US 2004/0206772 A1 Oct. 21, 2004

(51) Int. Cl.[7] ..... B67D 5/00

(52) U.S. Cl. ..... 222/83; 222/83.5; 222/181.1; 222/333; 141/330

(58) Field of Search ..... 222/83, 83.5, 185.1, 222/333, 82, 181.3, 181.1; 141/330, 309, 141/351–352, 293

(56) References Cited

U.S. PATENT DOCUMENTS

| | | | | |
|---|---|---|---|---|
| 3,072,299 | A | | 1/1963 | Sessions et al. |
| 3,092,106 | A | | 6/1963 | Butler |
| 3,098,586 | A | | 7/1963 | Wasserberg |
| 3,132,350 | A | | 5/1964 | Carlson |
| 3,230,550 | A | | 1/1966 | Carlson |
| 3,316,908 | A | | 5/1967 | Burke |
| 3,358,883 | A | | 12/1967 | Loe |
| 4,022,258 | A | | 5/1977 | Steidley |
| 4,183,105 | A | | 1/1980 | Womack |
| 4,216,553 | A | | 8/1980 | Haberle |
| 4,218,013 | A | | 8/1980 | Davison |
| 4,383,341 | A | | 5/1983 | Altman |
| 4,391,309 | A | * | 7/1983 | Steiner ..... 141/18 |
| 4,436,125 | A | * | 3/1984 | Blenkush ..... 141/330 |
| 4,521,156 | A | | 6/1985 | Napolitano |
| 4,562,867 | A | | 1/1986 | Stouffer |
| 4,627,798 | A | | 12/1986 | Thomas |
| 4,699,188 | A | | 10/1987 | Baker et al. |
| 4,712,983 | A | | 12/1987 | Moynihan |
| 4,872,225 | A | | 10/1989 | Wagner |
| 4,874,023 | A | * | 10/1989 | Ulm ..... 141/346 |

(Continued)

FOREIGN PATENT DOCUMENTS

DE 19905614 A1 10/2000

(Continued)

OTHER PUBLICATIONS

U.S. Appl. No. 10/439,467, filed May 16, 2003.

*Primary Examiner*—Frederick C. Nicolas

(57) ABSTRACT

A bottle adapter is disclosed for use with a liquid refill kit for an automated cleansing sprayer of the type having a reservoir tray having an upwardly extending well for supporting a bottle in an inverted orientation, wherein the well has a spring-loaded outlet valve. The refill kit includes the bottle for containing a liquid. The bottle has a piercable closure sealing an end of the bottle. The adapter has a central hole. The adapter is suitable for being situated between the closure and a bottom wall of the upwardly extending well in the sprayer for supporting the bottle. The adapter is configured such that if the bottle and adapter are installed in the well, movement of the closure relative to the well can result in movement of the adapter which in turn can result in movement of the outlet valve that controls the opening and closing of the valve.

21 Claims, 18 Drawing Sheets

U.S. PATENT DOCUMENTS 4,921,150 A 5/1990 Lagergren et al.
4,974,753 A 12/1990 Tucker et al.
4,991,635 A * 2/1991 Ulm ..... 141/346
4,998,850 A 3/1991 Crowell
5,004,159 A 4/1991 Kistner
5,031,676 A * 7/1991 Ulm ..... 141/346
5,086,950 A 2/1992 Crossdale et al.
5,102,010 A * 4/1992 Osgar et al. ..... 222/1
5,165,560 A 11/1992 Ennis, III et al.
5,205,251 A 4/1993 Conklin
5,215,447 A 6/1993 Wen
5,228,594 A 7/1993 Aslin
5,280,764 A 1/1994 Levinrad
5,356,036 A 10/1994 Garnett
5,360,127 A 11/1994 Barriac et al.
5,388,761 A 2/1995 Langeman
5,452,485 A 9/1995 Ross
5,533,651 A 7/1996 Eddy et al.
5,577,638 A 11/1996 Takagawa
5,636,794 A 6/1997 Hess et al.
5,655,887 A 8/1997 Chou
5,732,853 A * 3/1998 Ganzeboom et al. ..... 222/82
5,836,482 A 11/1998 Ophardt et al.
5,842,682 A 12/1998 Schennum et al.
5,848,736 A 12/1998 Boumann
5,853,034 A 12/1998 Edwards et al.
5,920,333 A 7/1999 Bates
5,961,011 A 10/1999 Thomas et al.
6,006,388 A 12/1999 Young
6,059,542 A 5/2000 Chou
6,095,370 A 8/2000 Rhine et al.
6,109,480 A 8/2000 Monsrud et al.
6,142,750 A 11/2000 Benecke
6,146,112 A 11/2000 Chou
6,200,110 B1 3/2001 Chou
6,206,058 B1 3/2001 Nagel et al.
6,213,725 B1 4/2001 Chou
6,230,501 B1 5/2001 Bailey, Sr. et al.
6,321,941 B1 11/2001 Argentieri et al.
6,328,543 B1 12/2001 Benecke
6,386,392 B1 5/2002 Argentieri et al.
6,390,335 B1 5/2002 Lawson et al.
6,427,730 B2 8/2002 Nagel et al.
6,463,600 B1 10/2002 Conway et al.
6,758,372 B2 * 7/2004 Studer et al. ..... 222/88
2002/0148908 A1 10/2002 Linstedt et al. ..... 239/223
2003/0071058 A1 4/2003 Sturder et al. ..... 222/88

FOREIGN PATENT DOCUMENTS

EP 365770 B1 5/1990
EP 369772 B1 5/1990
EP 1118300 A1 7/2001
EP 1190653 A1 3/2002
EP 1191166 A1 3/2002
EP 1191167 A1 3/2002
JP 10-328059 A1 12/1998
JP 11-005512 A1 1/1999
WO WO 96/22346 A1 7/1996
WO WO 98/02511 A1 1/1998
WO WO 00/32315 A1 6/2000
WO WO 01/23510 A2 4/2001
WO WO 01/52709 A1 7/2001
WO WO 01/52710 A1 7/2001
WO WO 02/084034 A2 10/2002

* cited by examiner

FIG. 1
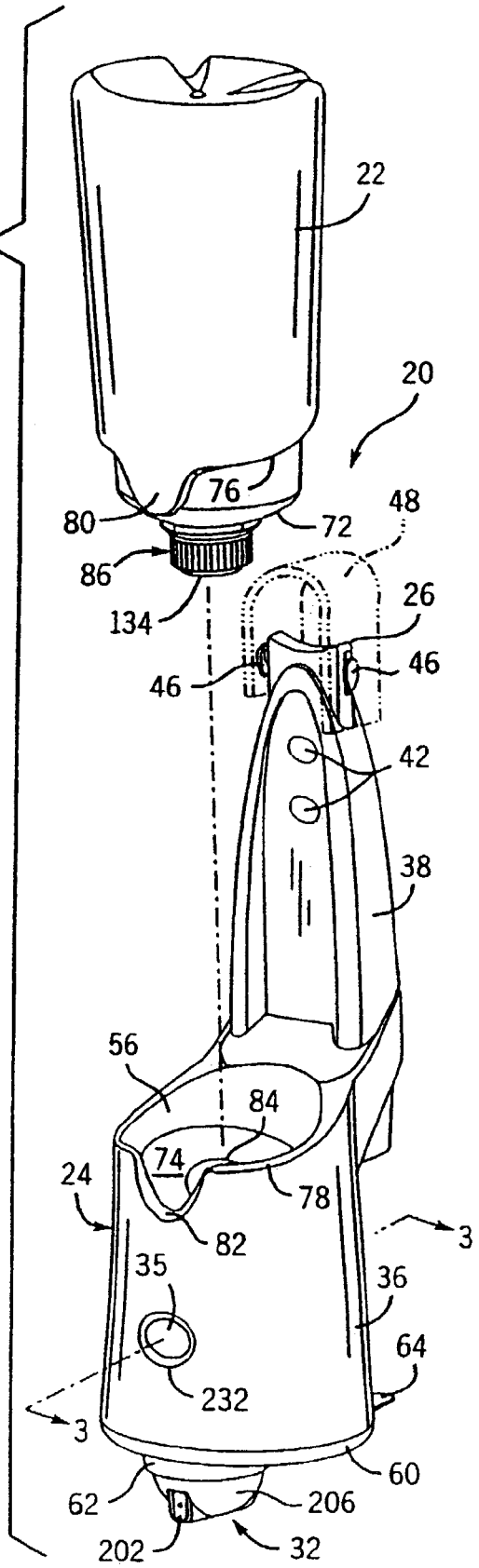
FIG. 8
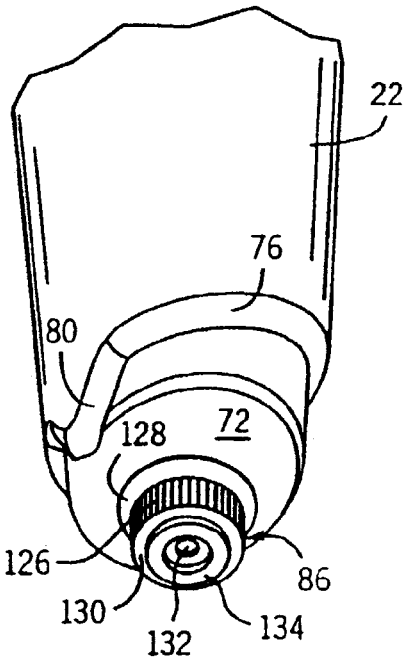
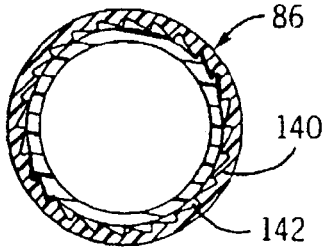
FIG. 13

168
162
160
28
156

42
50
38
44
22
56
24
4
98
86
68
96
36
84
97
70
66
232
97
5
35
166
182
192
6
6
64
216
202
4
5
32
206

FIG. 14
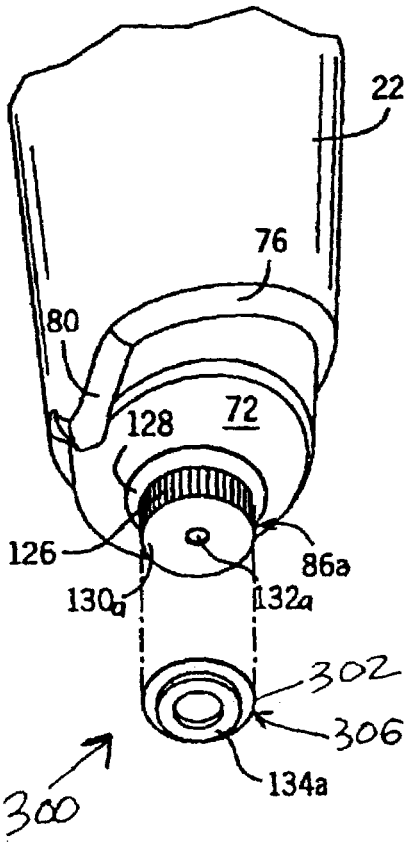
FIG. 20
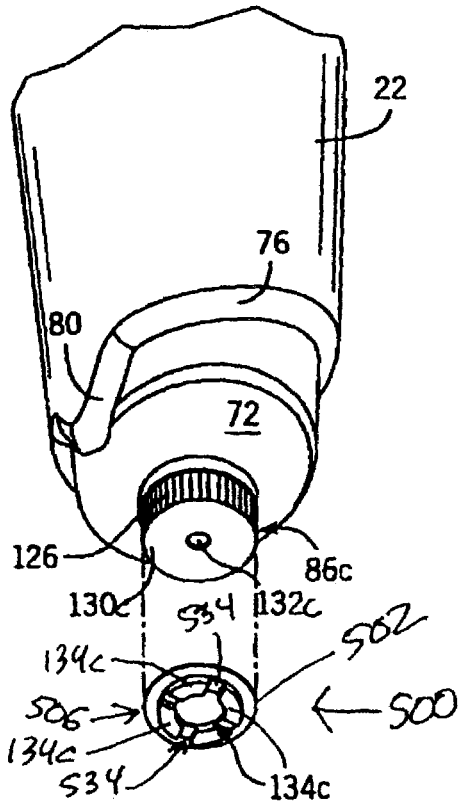
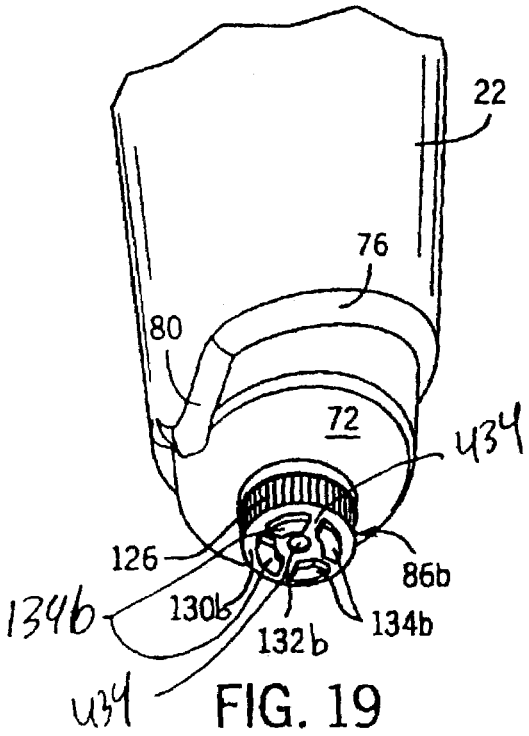
FIG. 19

FIG. 27
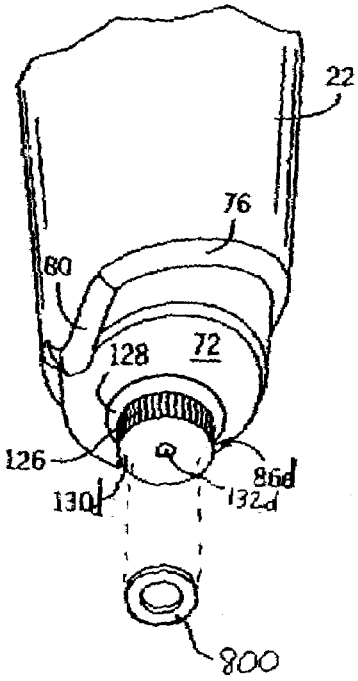
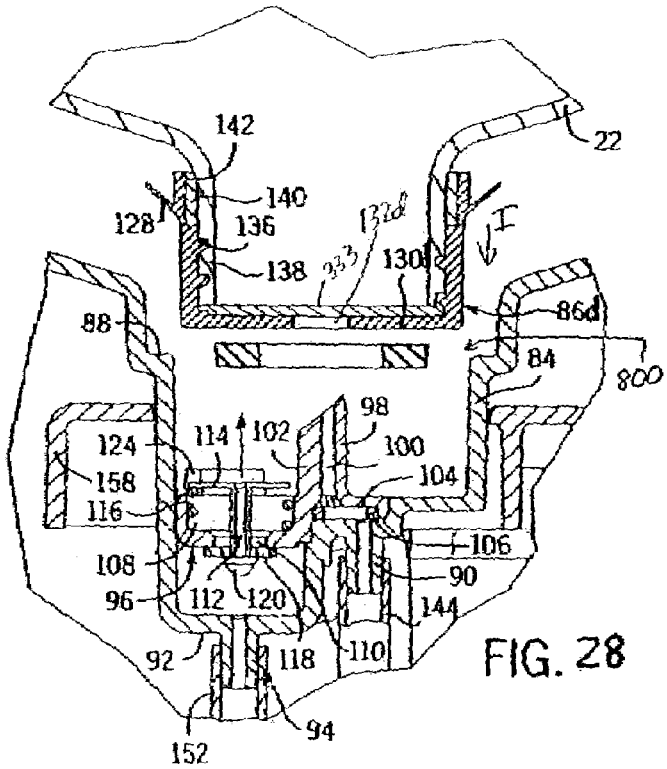
FIG. 28
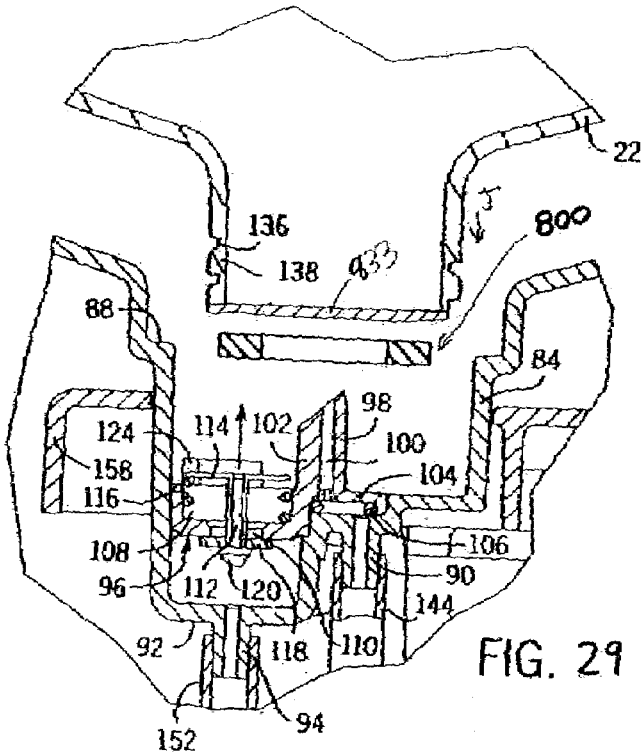
FIG. 29

BOTTLE ADAPTER FOR DISPENSING OF CLEANSER FROM BOTTLE USED IN AN AUTOMATED CLEANSING SPRAYER

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to a sprayer that is designed to automatically clean enclosures. More particularly, the invention relates to a bottle adapter for use with a bottle for an automated sprayer for spraying the walls of an enclosure with a liquid cleanser.

The walls and doors of shower/bathing enclosures can become mildewed, coated with soap build up or hard water and mineral deposits, or become otherwise soiled, during typical use. Removing these deposits and stains normally requires one to scrub the walls and doors by hand, which is an undesirable task.

To assist in this task, cleaning chemicals may be sprayed, squirted, or otherwise applied on the surfaces to be cleaned. After allowing the active ingredients some time to "work", the walls are then wiped with a cloth, brush, or scrubbing pad, and then rinsed with water.

In some cases these cleaners are so effective that the amount of scrubbing can be somewhat reduced (particularly if the cleaners are used on a daily basis). See generally, WO 96/22346 and WO 98/02511.

However, for these "no scrub" cleaners to work well they preferably should be applied immediately after the shower has been used. This requires a consumer to keep a pump spray bottle of the cleanser in or near the shower enclosure (further cluttering the shower area), that the consumer remember to do the spraying (which may be problematic if the consumer has just woken up), and that the consumer be willing to spend the time to spray the enclosure (for example they may be running late in the morning).

An alternative approach is to provide an automated cleaning system for a shower. For example, U.S. Pat. No. 4,872,225 discloses a sprayer and conduit system for a bath and shower enclosure. The unit is associated with the showerhead. Supply water can be diverted to the sprayer for cleaning the enclosure. A container of cleanser is mounted in the shower enclosure for introducing cleanser (through an injector assembly) for spraying cleanser on the walls.

A drawback with this system is that the user must manually turn on the supply water (if it is not already on), adjust the diverter, squeeze cleanser into the sprayer and shut off the water after the walls have been washed. There is also some risk that the consumer will be sprayed with the cleanser.

Other automated enclosure cleaning systems are more elaborate, such as that disclosed in U.S. Pat. No. 4,383,341, which includes multiple pop-out spray nozzles connected by a manifold to a mixing valve where cleaning concentrate is mixed with water. Thus, it is not something that a consumer can easily and inexpensively retrofit to their shower enclosure.

U.S. Pat. No. 5,452,485 discloses an automatic cleaning device for a tub and shower having large, powered tub and shower "gliders" that move in tracks around the tub and shower stall, respectively. The gliders are coupled to the water supply, which is mixed with a cleanser. The gliders have spray heads for spraying the cleaning solution on the tub and shower walls. The gliders also have brushes for scrubbing the walls. A user operates the gliders and cleanser mixing by a central controller. Again, this system is not suitable for easy and inexpensive retrofitting.

It seems particularly desirable to develop a relatively small automated dispenser that can be hung from a showerhead, shower enclosure wall, or the like, yet dispense cleanser without the need for drawing water from the building supply. It would also be desirable for such a system to accept inverted bottles of cleaning fluid.

However, developing such a system has significant challenges. For example, controlling the flow of cleanser to the sprayer to avoid waste can be difficult. Also, it is highly desirable to provide for control over the types of cleaning fluid that can be used with the equipment. The present invention seeks to address these needs.

SUMMARY OF THE INVENTION

In one aspect, the invention provides a liquid refill kit for an automated cleansing sprayer of the type having a reservoir tray having an upwardly extending well for supporting a bottle in an inverted orientation wherein the well has a spring-loaded outlet valve. The refill kit includes a bottle that is suitable to contain a liquid (for example a cleanser such as that described in WO 96/22346) and an adapter. The bottle has a cap closing an end of the bottle, and the cap is formed with a central piercable surface. The adapter has a central hole and is suitable for being situated between the bottle cap and the bottom wall of the upwardly extending well in the sprayer for supporting the bottle. The adapter is configured such that if the cap and adapter are installed in the well, movement of the cap relative to the well can result in movement of the adapter which in turn can result in movement of the outlet valve that controls the opening and closing of the valve.

In one form, the adapter has a radial air passageway and a central air passageway to allow air outside the bottle to pass through the adapter and the cap and enter into the bottle when a suitable opening is created in the cap. In another form, the adapter is a ring having a central hole and a plurality of projecting arc segments around the hole.

In another aspect, the invention provides a dispenser for dispensing a liquid. The dispenser includes a bottle suitable to contain the liquid, a reservoir tray having an upwardly extending well for supporting the bottle in an inverted orientation, a cap closing an end of the bottle, and an adapter situated between the cap and a bottom of the well. The well has a spring-loaded outlet valve that permits outflow from the well when movement of the cap relative to the well results in movement of the adapter causing movement of the outlet valve. In one form, the adapter has a radial air passageway and a central air passageway to allow air outside the bottle to pass through the adapter and the cap and enter into the bottle when a suitable opening is created in the cap.

In yet another aspect, the invention provides a liquid refill kit for an automated cleansing sprayer of the type having a reservoir tray having an upwardly extending well for supporting a bottle in an inverted orientation, wherein the well has a spring-loaded outlet valve. The refill kit includes a bottle that is suitable to contain a liquid and has a cap installed on an end of the bottle. The cap is formed with a central hole, and the central hole is sealed with a piercable liner. The refill kit further includes an adapter having a central hole and being suitable for being situated between the bottle cap and a bottom wall of the upwardly extending well in the sprayer for supporting the bottle. The adapter is configured such that if the cap and adapter are installed in the well, movement of the cap relative to the well can result in movement of the adapter which in turn can result in movement of the outlet valve that controls the opening and closing of the valve. In one form, the liner is positioned between the cap and the bottle.

The adapter may have a radial air passageway and a central air passageway to allow air outside the bottle to pass through the adapter and the cap and enter into the bottle when a suitable opening is created in the cap. The adapter may be a ring having a central hole and a plurality of projecting arc segments around the hole.

In still another aspect, the invention provides a dispenser for dispensing a liquid. The dispenser includes a bottle suitable to contain the liquid, a reservoir tray having an upwardly extending well for supporting the bottle in an inverted orientation, and a cap installed on an end of the bottle. The cap is formed with a central hole sealed with a piercable liner prior to placement of the bottle in the tray. An adapter is situated between the cap and a bottom of the well. The well has a spring-loaded outlet valve that permits outflow from the well when movement of the cap relative to the well results in movement of the adapter causing movement of the outlet valve.

In yet another aspect, the invention provides a liquid refill kit for an automated cleansing sprayer of the type having a reservoir tray having an upwardly extending well for supporting a bottle in an inverted orientation, wherein the well has a spring-loaded outlet valve. The refill kit includes a bottle that is suitable to contain a liquid and has a piercable closure sealing an end of the bottle. The kit also includes an adapter having a central hole. The adapter is suitable for being situated between the closure and a bottom wall of the upwardly extending well in the sprayer for supporting the bottle. The adapter is configured such that if the bottle and adapter are installed in the well, movement of the closure relative to the well can result in movement of the adapter which in turn can result in movement of the outlet valve that controls the opening and closing of the valve. In one form, the closure comprises a closed cell foam. The kit may also include a cap installed on the end of the bottle such that the closure is positioned between the cap and the bottle before the bottle and the adapter are installed in the well. The cap is suitable for being removed before the bottle and the adapter are installed in the well.

The adapter may have a radial air passageway and a central air passageway to allow air outside the bottle to pass through the adapter and the cap and enter into the bottle when a suitable opening is created in the cap. The adapter may be a ring having a central hole and a plurality of projecting arc segments around the hole.

In still another aspect, the invention provides a dispenser for dispensing a liquid. The dispenser includes a bottle suitable to contain the liquid, a reservoir tray having an upwardly extending well for supporting the bottle in an inverted orientation, and a piercable closure for sealing an end of the bottle before the bottle is installed in the well. The dispenser also includes an adapter with a central hole. The adapter is situated between the closure and a bottom of the well. The well has a spring-loaded outlet valve that permits outflow from the well when movement of the closure relative to the well results in movement of the adapter causing movement of the outlet valve. In one form, the closure comprises a closed cell foam.

These and other advantages of the invention will be apparent from the detailed description which follows and the drawings. It should be appreciated that what follows is merely a description of preferred embodiments. That description is not meant as a limitation of the full scope of the claims. Rather, the claims should be looked to in order to judge the full scope of the invention.

BRIEF DESCRIPTION OF THE DRAWINGS

FIG. 1 is a partially exploded perspective view of an automated sprayer with a cleanser bottle shown inverted prior to being set into the sprayer, the sprayer being of the type whose bottle and cap can be replaced with the bottle/cap/adapter of the present invention;

FIG. 8 is a partial reverse perspective view of the cleanser bottle with its bottle cap;

FIG. 13 is a cross-sectional view taken along line 13—13 of FIG. 10;

FIG. 14 is a partial reverse perspective view of a cleanser bottle with a bottle cap with an adapter according to a preferred aspect of the invention;

FIG. 19 is a view similar to FIG. 8, but of another embodiment of a bottle and bottle cap;

FIG. 20 is a view similar to FIG. 14, but of the FIG. 19 embodiment where the cap has been split into a main cap and another adapter according to the invention;

FIG. 27 is a view similar to FIG. 14, but of another adapter according to the invention;

FIG. 28 is a view similar to FIG. 23 with the adapter of FIG. 27; and FIG. 29 is a view similar to FIG. 25 with the adapter of FIG. 27.

DETAILED DESCRIPTION OF THE PREFERRED EMBODIMENTS

Figure 2A:
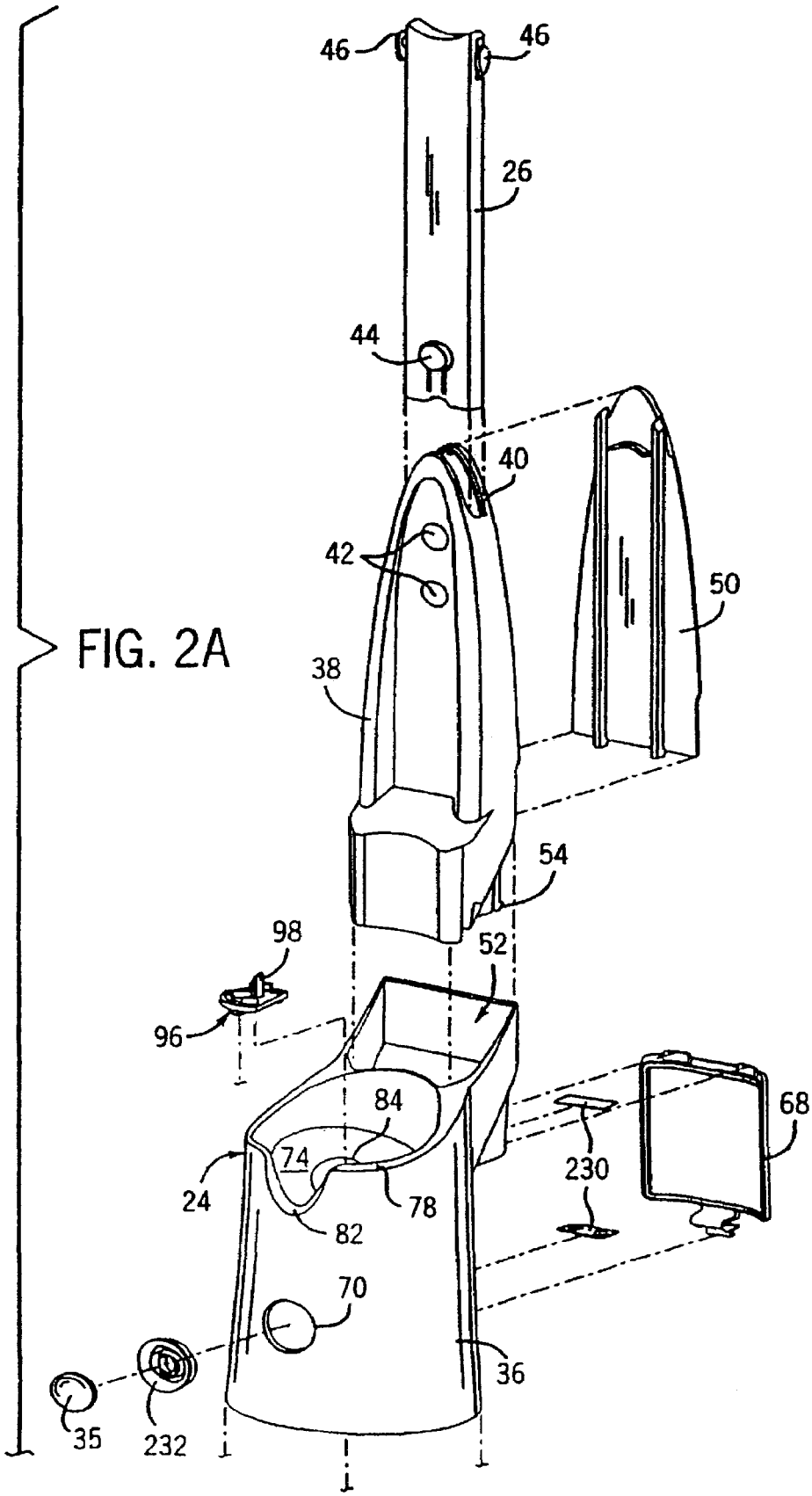
FIGS. 2A and 2B are more detailed exploded perspective views of the sprayer of FIG. 1.
Figure 2B:
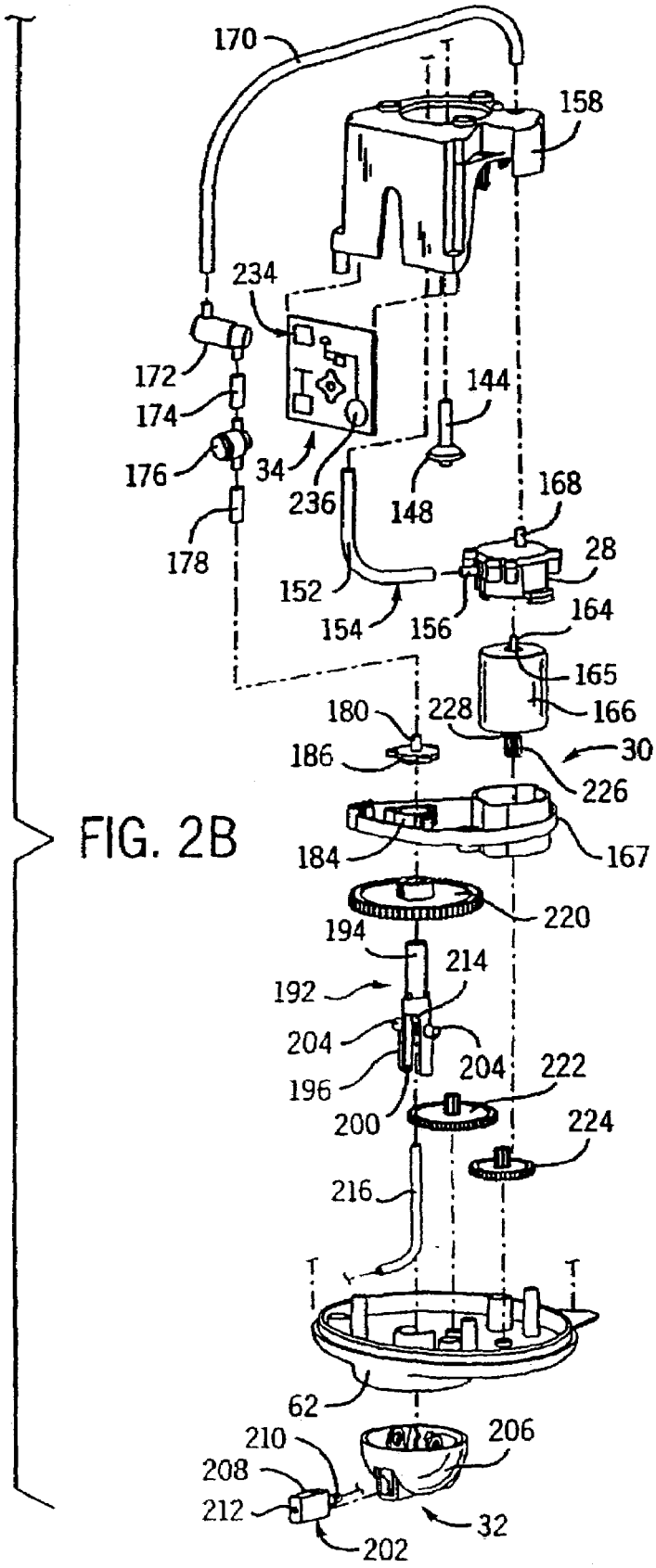
Figures 2C, 3:
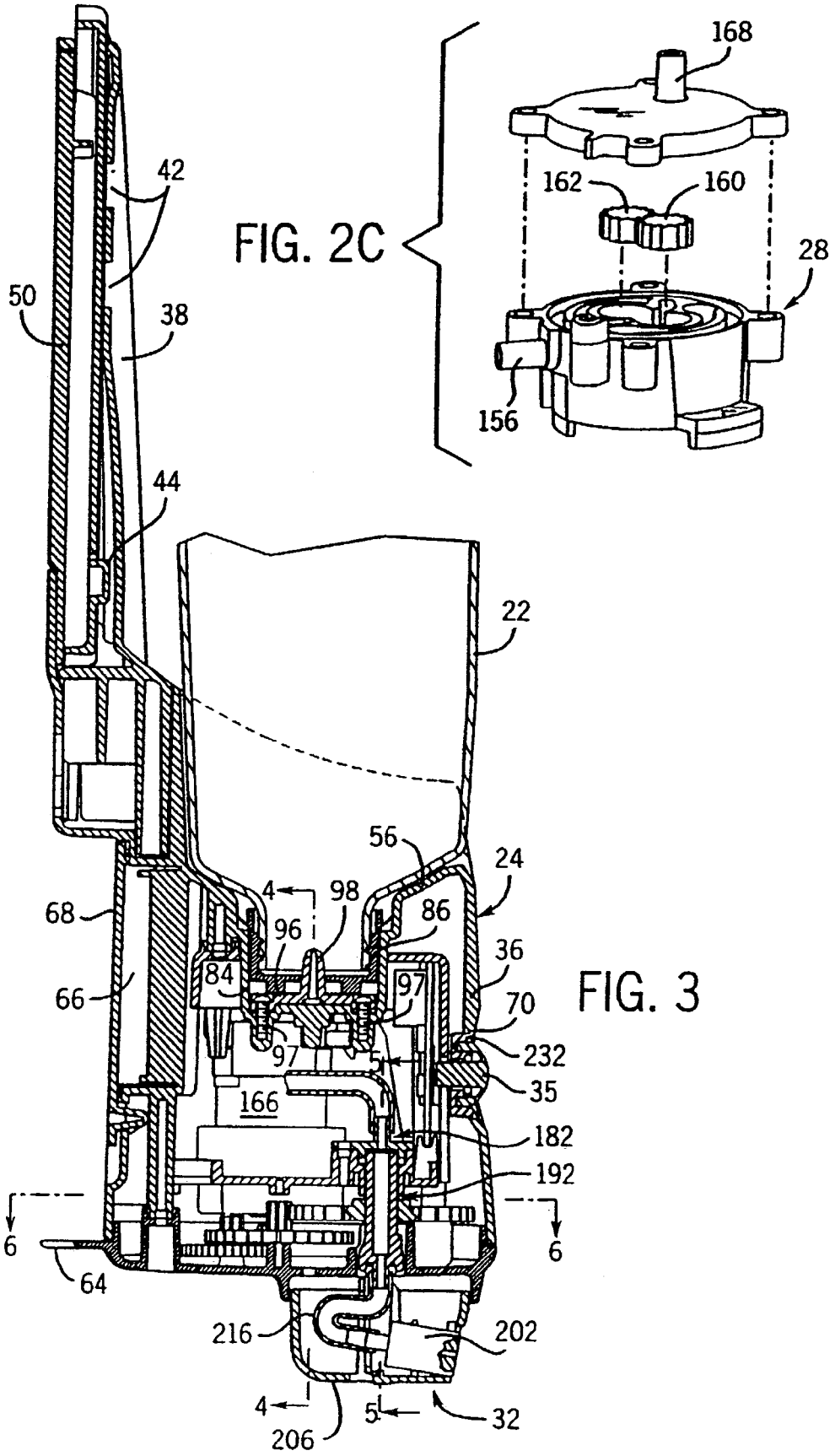
FIG. 2C is an exploded perspective view of one possible pump used in the sprayer.
FIG. 3 is a side cross-sectional view of the sprayer taken along line 3—3 of FIG. 1.

As background, we describe an automated sprayer generally referred to in the figures by reference number 20. With particular reference to FIGS. 1–2B, the sprayer 20 includes as main components a bottle 22, a housing 24 with an adjustable hanger 26, a pump 28, a drive mechanism 30, a spray head 32 and a control circuit 34. The sprayer is typically suspended via the hanger from a shower spout or the like and then activated via a button 35 at the front of the sprayer to rotate a spray head and pump cleanser from the bottle out of the spray head during a spray cycle of a prescribed time period, after which dispensing is automatically terminated.

The exterior of the sprayer is defined by the housing 24, which can be molded from, for example, plastic by any suitable technique and consists primarily of two pieces, a receptacle 36 and a hanger tower 38 that easily snaps into a pocket in the receptacle. This allows the sprayer to be shipped and stored in a compact package with minimal assembly by the consumer. The hanger tower 38 is an upright member defining a cavity in which the elongated body of the hanger 26 fits through an opening 40 at its upper end. The upper end of the hanger tower 38 has two oval-openings 42 vertically spaced apart.

A deflectable tab 44 formed in the lower end of the hanger can snap into one of the openings to lock the hanger at either of two extended positions. The hanger is extended and locked in the lower opening by simply pulling it away from the hanger tower. In this position, the sprayer 30 will hang from standard shower spouts at an appropriate height for spraying down the shower walls. The height can be adjusted by depressing the tab inwardly and sliding the hanger up or down. The hanger itself has two ears 46 at its upper end for mounting a rubber strap 48. The ears can be tapered to ease connection of the strap, which can have a series of holes at one end for adjustment purposes so that the strap fits tightly around a shower spout or the like. The back side of the hanger tower is closed by a back plate 50. The hanger tower connects to the receptacle at its lower end, which fits into a pocket 52 and has two latches 54 (one shown) that snap into two slots in the back of the receptacle.

Figure 4:
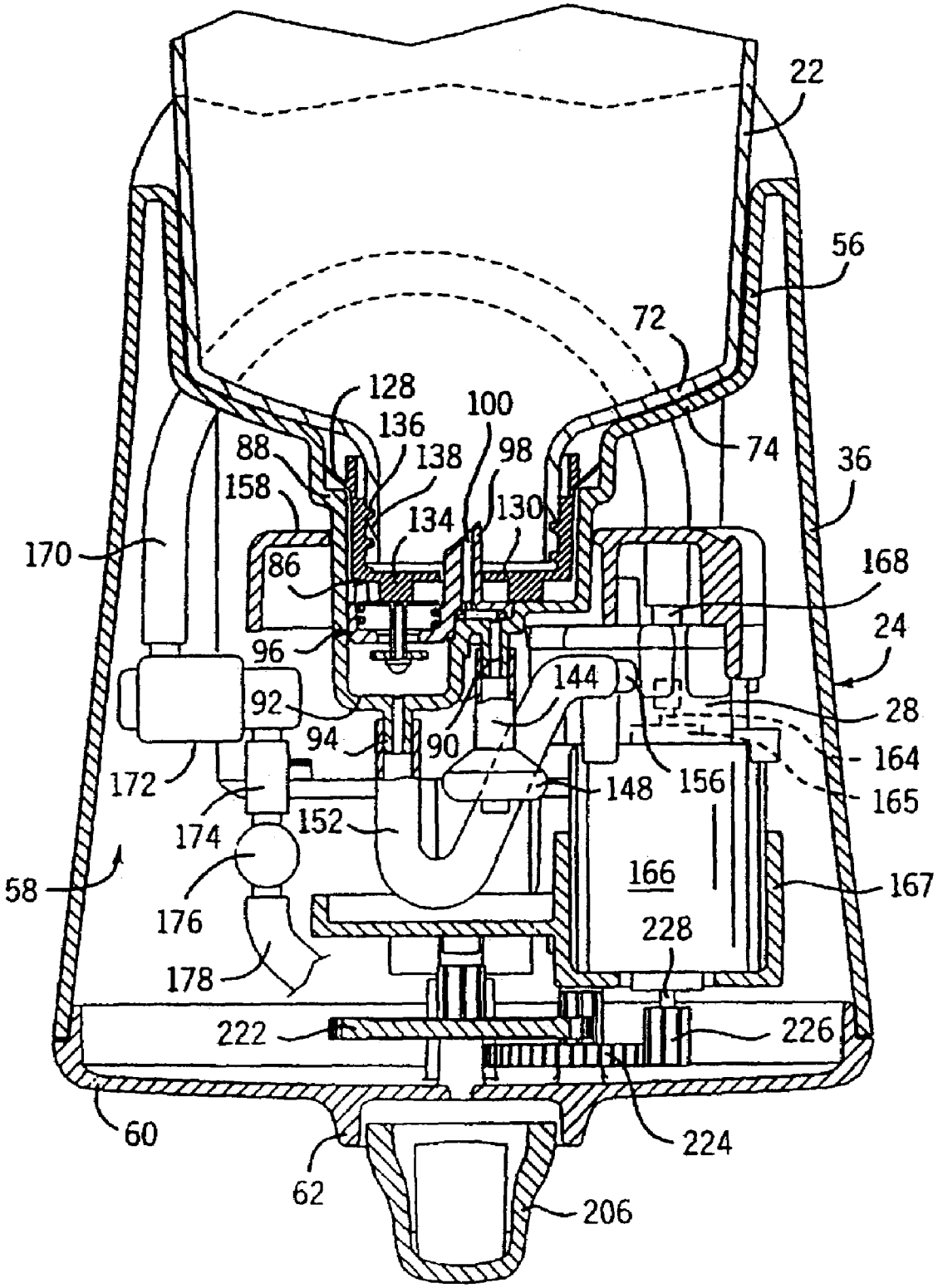
FIG. 4 is a partial cross-sectional view taken along line 4—4 of FIG. 3 showing the pump and drive mechanism with the pump and a drive motor shown in full.

The receptacle defines an upwardly opening bottle tray 56 above a compartment 58 (see FIG. 4) containing the pump and drive mechanism which is closed at the bottom by a cover 60. The cover has a circular skirted opening 62 for the spray head and a wall stand-off 64 extending backward the distance of the pocket to brace the lower end of the receptacle against the wall and keep it plumb. The back side of the receptacle defines a battery compartment 66 with a lid 68 and the front side has an oval switch opening 70 for the control button 35.

The tray 56 is formed to mate with a specially contoured upper end of the bottle. The bottle and tray are generally oval and have mating seating surfaces 72 and 74 and sloped shoulders 76 and 78 with complementary V-shaped features 80 and 82, respectively. These features and the contour of the shoulders fix the orientation of the bottle in the tray and make conventional cleanser bottles incompatible with proper operation of the sprayer.

Referring next to FIGS. 9–12, the tray defines a circular well 84 at the center of the seating surface 74 accommodating a special cap 86 screwed onto the mouth of the bottle. The well is formed with a shoulder portion 88, a vent nipple 90 and a recess 92 with a discharge nipple 94. The well supports a valve plate 96 (see FIG. 2A) fastened thereto by two screws 97 (see FIG. 3). The valve plate has a piercing post 98 projecting up from the valve plate. The post has a slanted top end defining a sharp point and defines a vent passageway 100 and three radial ribs 102. The vent passageway extends into a recess 104 at the underside of the valve plate accommodating a small o-ring 106 surrounding the vent passageway and the opening in the vent nipple 94. The valve plate also defines a valve recess 108 with a discharge passageway 110 through which a valve stem 112 extends. The upper end of the valve stem has a cross-shaped plunger 114 that is biased away from the well by a coil spring 116 fit into the valve recess.

Figure 10:
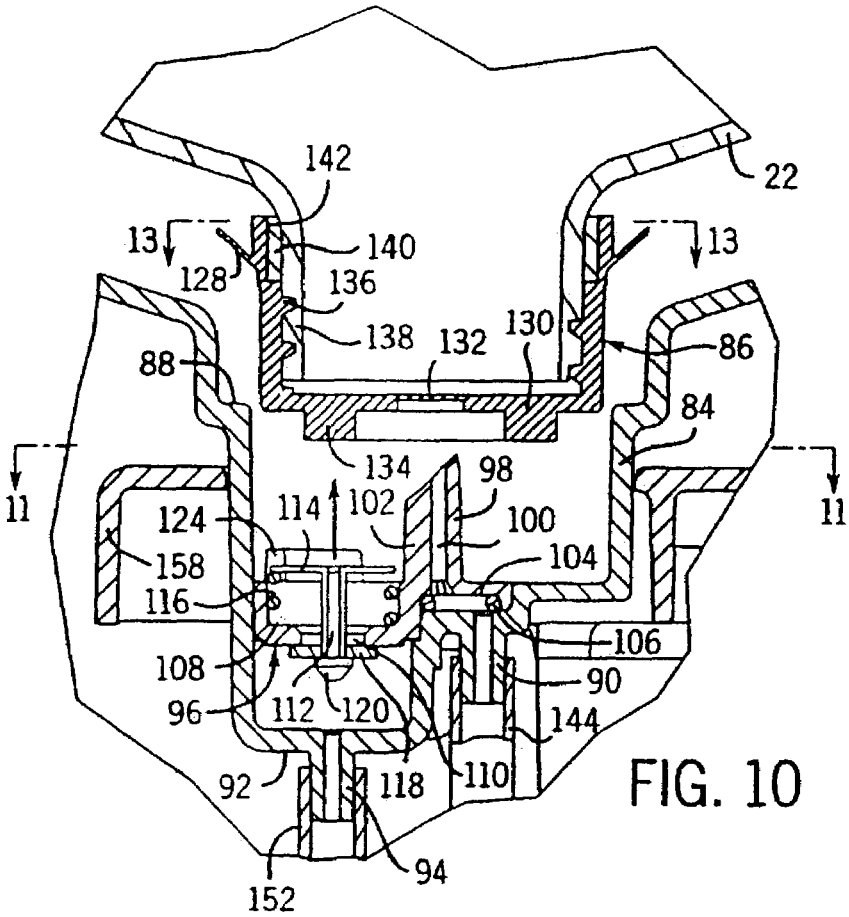
FIG. 10 is a view similar to FIG. 9 although with the bottle unseated from the tray and the discharge valve closed.
Figure 11:
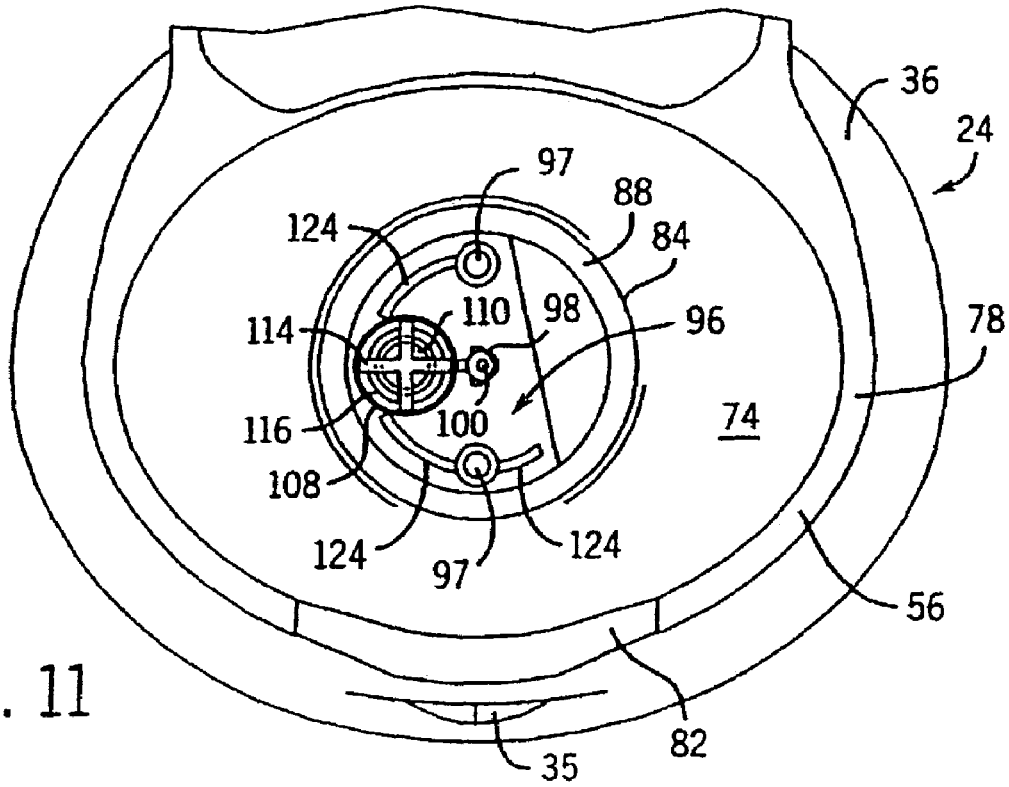
FIG. 11 is a top view of the tray with the bottle removed.
Figure 12:
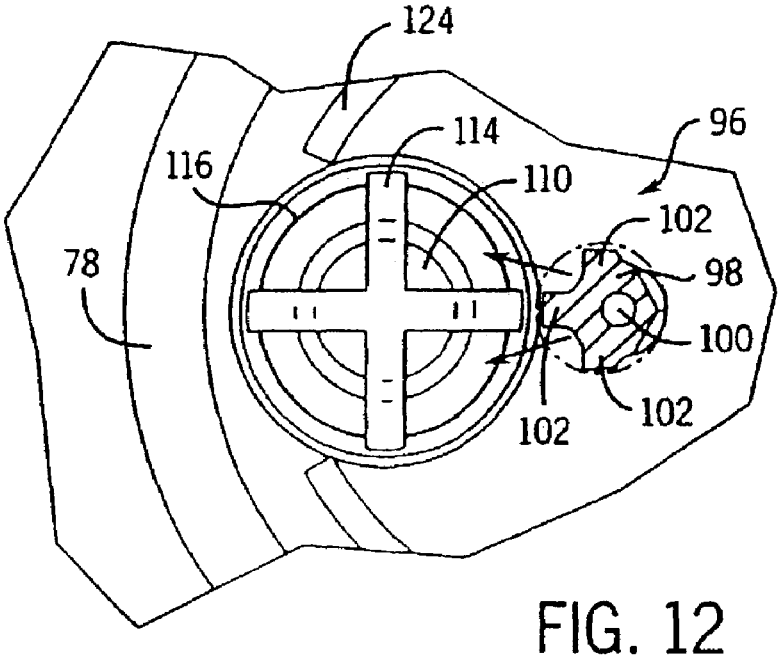
FIG. 12 is an enlarged partial top view showing the discharge valve and piercing post.

The lower end of the valve stem mounts a disc-shaped rubber gasket 118 retained by an enlarged end 120 of the valve stem. As shown in FIG. 10, the plunger is biased upward by the spring so that the gasket seals against the underside of the valve plate so as to close off the discharge orifice when the sprayer is not being used. The valve plate also defines arcuate stand-offs 124 spaced in slightly from its periphery. The valve plate and the well are designed to cooperate with the specially designed bottle cap (described below) to discourage use of unaffiliated cleanser and thereby promote proper operation of the sprayer.

Referring next to FIGS. 8–11, the cap is generally circular with a serrated periphery 126 and a tapered sealing flange (or web) 128 that seals against the tray well above its shoulder. The top of the cap has an outer surface 130 with a recessed thinned area 132 at its center around which is a raised ring surface 134 extending to a plane spaced from surface 130. The thinned area 132 is located so that as the bottle is seated in the tray the piercing post will puncture the cap in this area to permit discharge of the cleanser and venting of the bottle. The raised ring is located to contact the plunger of the valve and push the valve downward to unseat the gasket from the plate and open the discharge orifice. The flat surface 130 of the cap rests on the stand-offs 124 to space the punctured area from the floor of the well.

This arrangement thus provides a no-mess means of opening and inserting the bottle, but also further inhibits uses of improper cleanser containers. It does this for several reasons. First, if a conventional bottle and cap were inserted into the tray, the piercing post would not puncture a conventional cap lacking the weakened area. Even if the cap was removed so that the mouth was opened, the sprayer still would not operate because the valve is located radially inward of the place where a conventional thin-walled bottle mouth would normally extend so that the valve would not be opened.

Another feature-that serves this purpose is the conforming sloping of the bottle shape and receiving well. A bottle not having a complementary shape would not be received sufficiently low to activate the outlet valve.

Also, while the cap has conventional internal threads 136 at its upper end that mate with threads 138 on the mouth of the bottle, and it also has a ring of one-way ratchet teeth 140 that engage corresponding ratchet teeth 142 on the bottle (see FIG. 13). The ratchets allow the cap to be turned in a tightening direction but resist untightening rotation to prevent non-destructive removal of the cap and thus refilling of the bottle.

FIGS. 2B–6 show the pump, controller, and drive mechanism contained inside the receptacle compartment beneath the bottle tray. These components will now be described working from the bottle-tray interface to the spray head. A short vent tube 144 couples to the vent nipple 146 defining the vent orifice in the tray well. A small check valve 148 fits into the end of the vent tube. The check valve is normally closed so that cleanser does not leak out via that path. The valve opens by negative pressure that develops as cleanser is withdrawn from the bottle. The opened check valve aspirates the air to the bottle to allow the cleanser to flow from the bottle in a consistent manner, without introducing air in a manner that would cause foaming or gurgling. The check valve remains open until the pressure in the bottle has equalized sufficiently to alleviate the negative pressure and then it closes.

From the discharge nipple defining the discharge orifice of the tray well a first tube 152 of a dispenser line 154 extends to an inlet barb 156 of the pump 28, which snaps into a support 158 mounted to the underside of the bottle tray. The pump can be any conventional pump, such as a diaphragm pump, a piston pump, a peristaltic pump, or even a gear pump as shown. The inlet defines a passageway leading-between intermeshing drive gear 160 and idler gear 162 (see FIG. 2C). The drive gear is connected to an upper shaft 164 (surrounded by o-ring 165) of a direct-current motor 166 mounted through an opening in a gear plate 167 mounted to the lower cover of the receptacle. Operation of the motor rotates the drive gear which meshes with and turns the idler gear as conventional to draw cleanser from the bottle and through to an outlet barb 168. A second tube 170 connects the outlet barb to a filter 172. The filter accumulates cleanser within its housing and aids in priming the pump. A short tube 174 of the dispenser line connects the filter 172 to another check valve 176 which is connected by another short tube 178 continuing a spring 179 for support to an inlet barb 180 of a shaft junction 182.

Figure 5:
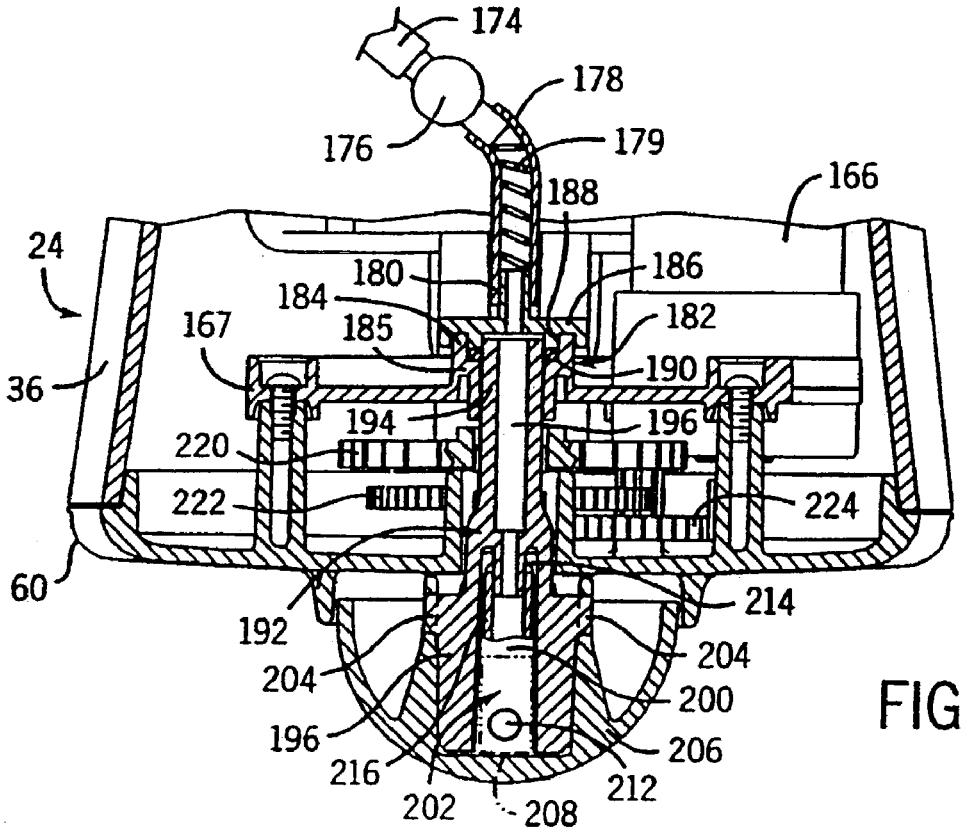
FIG. 5 is a horizontal cross-sectional view taken along line 5—5 of FIG. 3 showing the spray head drive and junction with the dispenser tube.
Figure 6:
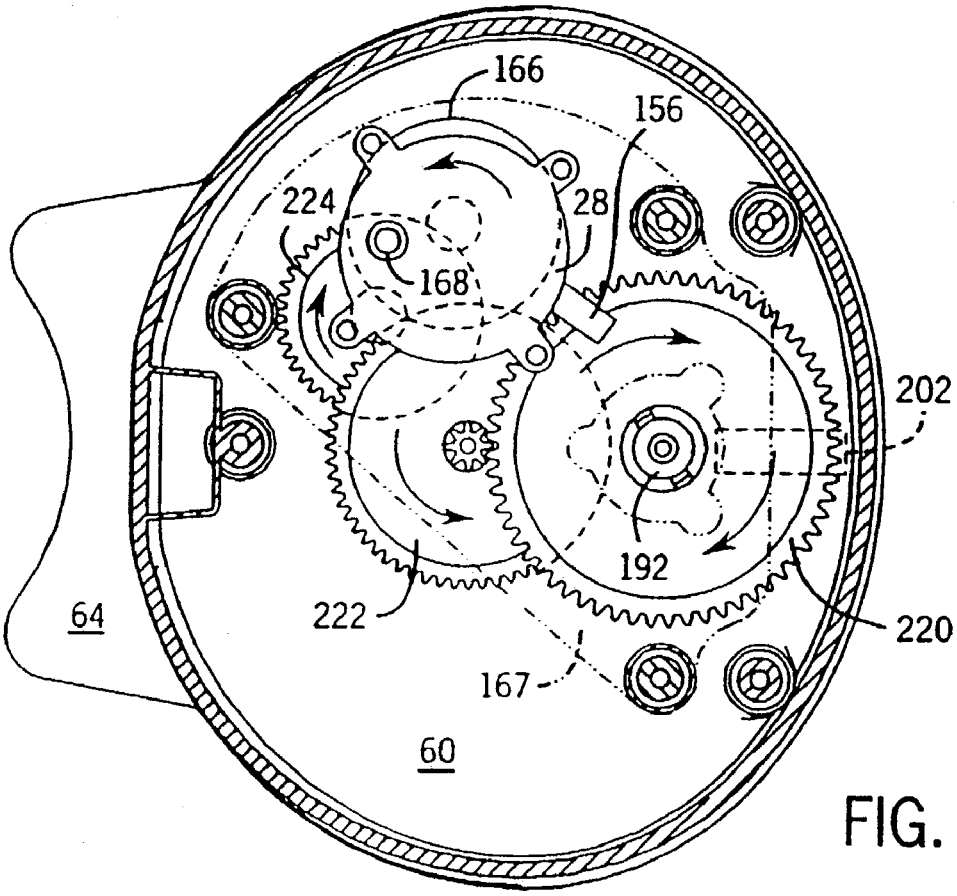
FIG. 6 is a cross-sectional view taken along line 6—6 of FIG. 3 showing the gear train for the spray head drive.

Referring to FIGS. 2B and 5, the stationary portion of the junction 182 is a chamber formed in part by the gear plate at a circular wall 184 having an inner shoulder 185 and covered at one end by a cap 186. The cap includes the inlet barb 180 and a raised annular ring 188 extending downwardly within the circular wall to press an o-ring 190 against the shoulder. The o-ring seals against the upper end of a rotating spray head drive shaft 192, which forms the rotating portion of the function. The drive shaft is an inverted Y-shaped structure with a cylindrical stem 194 defining a passageway 198 and a forked end 196 extending down through an opening in the receptacle cover and defining a gap 200 accommodating a spray nozzle 202. The forked end has lateral mounting posts 204 onto which snaps a dome-shaped cover 206 concealing the spray nozzle 202.

The spray nozzle is preferably a fluidic oscillator providing oscillating spray (in this case up and down), however, any other suitable nozzle could be used. See e.g. U.S. Pat. No. 4,562,867 which shows examples of known fluidic oscillators. Such a fluid oscillator can be any suitably sized oscillator including a housing 208 with an inlet 210 and an outlet 212 on opposite sides. A barrier member (not shown) in the interior of the housing defines a passage between the inlet and the outlet so that cleanser entering the inlet passes through and around the barrier member to the outlet. The fluidic oscillator operates, as known in the art, by creating areas of low pressure at alternate sides of the passage through the barrier member to convert the straight flow entering the housing to an oscillating pattern.

The nozzle is coupled to an outlet barb 214 extending from the stem by another tube 216. The nozzle is mounted so that its outlet end extends through the opening in the cover pointed downwardly at approximately a 30 degree angle. A drive gear 220 is press fit onto the stem of the drive shaft and meshes with a first reducer gear 222 which is rotated by another smaller diameter reducer gear 224 driven by a pinion 226 at the end of lower motor shaft 228. The gear train couples to the motor to the spray head at a reduced revolution per minute rate-than the motor shaft. This arrangement provides a revolving, oscillating spray pattern.

Also mounted to the support within the receptacle compartment is the control circuitry 34 which is electrically coupled to a direct current power supply via battery terminals 230 (see FIGS. 2A and 7) in the battery compartment and to the push-button switch 35, which is mounted through the opening 70 in the front of the receptacle through a lighted watertight, flexible membrane 232. The circuitry includes timing circuitry 234 and a speaker 236 that functions as-described below.

Figure 7:
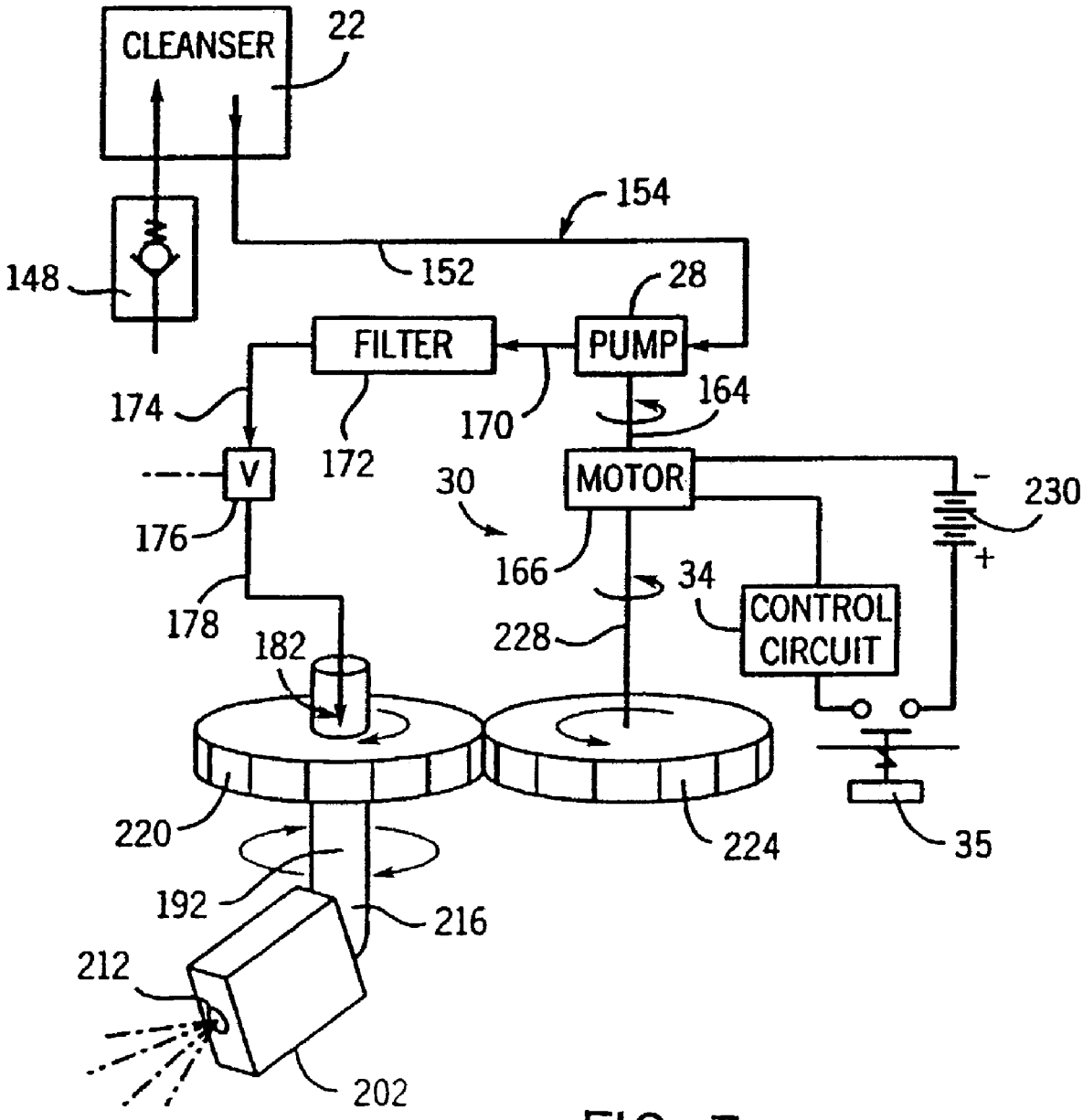
FIG. 7 is a schematic diagram showing a control circuit and cleanser flow path.
Figure 9:
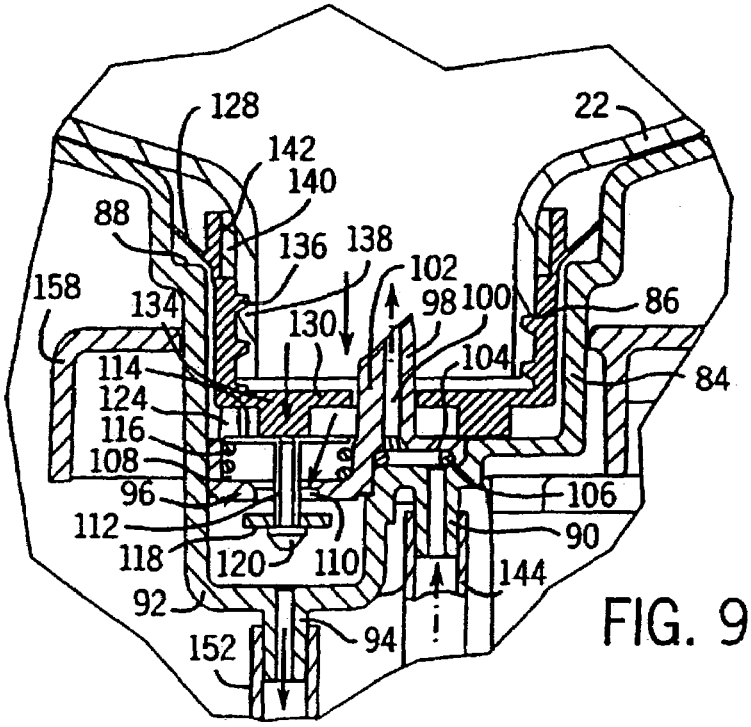
FIG. 9 is an enlarged view of the bottle-tray interface with the bottle seating in the tray and a discharge valve open.

The electrical arrangement as well as the dispensing line and bottle venting flow paths are shown in FIG. 7 and the sprayer is operated as follows. When a bottle is loaded into the sprayer (that is, the bottle is inverted and set into the receptacle tray), the thinned area of the bottle cap is punctured by the piercing post, the cap sealing flange seals against the tray well and the annular ring contacts and depresses the plunger of the discharge valve to open-the valve. Cleanser pours out of the bottle between and around the ribs of the piercing post and is replaced by an equal volume of air through the vent tube.

Because air is lighter than the cleanser, it is displaced to the top of the bottle where it is trapped. Cleanser pours out of the bottle and drains through the valve plate and into the dispenser line, through the pump, past the filter until it reaches valve 176. Until the sprayer is operated, the sprayer remains in this state of equilibrium in which no cleanser flows from the bottle.

When a user wishes to spray the enclosure walls with cleanser, he or she simply depresses the switch at the front of the sprayer. This signals timing circuitry to begin a countdown delaying spraying for a predetermined time, such as 20 seconds. This affords the user time to exit the shower enclosure and close the doors or curtains. It also may provide the user time to abort the spray cycle by depressing the switch a second time. Initially depressing the switch may also send a pulsed tone to the speaker and flashes the lighted ring around the switch for warning the user of the impending operation of the sprayer.

Unless cancelled by the user, the spray cycle begins automatically at the expiration of the countdown. The motor is then energized which simultaneously rotates the drive gear of the pump and turns the gear train to rotate the drive shaft and the spray head. At the same time, the pump draws cleanser from the bottle through the dispenser line and opens valve 176 so that cleanser can flow through the junction and be expelled through the nozzle as the spray head is rotated, thereby providing a circular, oscillating spray pattern. This reduces the level of cleanser in the bottle, creating a negative pressure in the bottle, which opens the check valve in the vent tube to aspirate the bottle and allow more cleanser to be drawn from the bottle during the spray cycle.

The motor continues to be energized until the expiration of a second countdown performed by the timing circuit, preferably another 20 second interval, automatically initiated by the timer. At that point the motor is deenergized which shuts down the pump causing valve 176 to close. Closing the valve prevents cleanser from leaking out of the dispenser line and also keeps the cleanser in the line upstream from the valve so that the pump remains primed. The sprayer thus returns to stand-by mode without further intervention from the user, ready for another spray cycle at the demand of the user.

Figure 15:
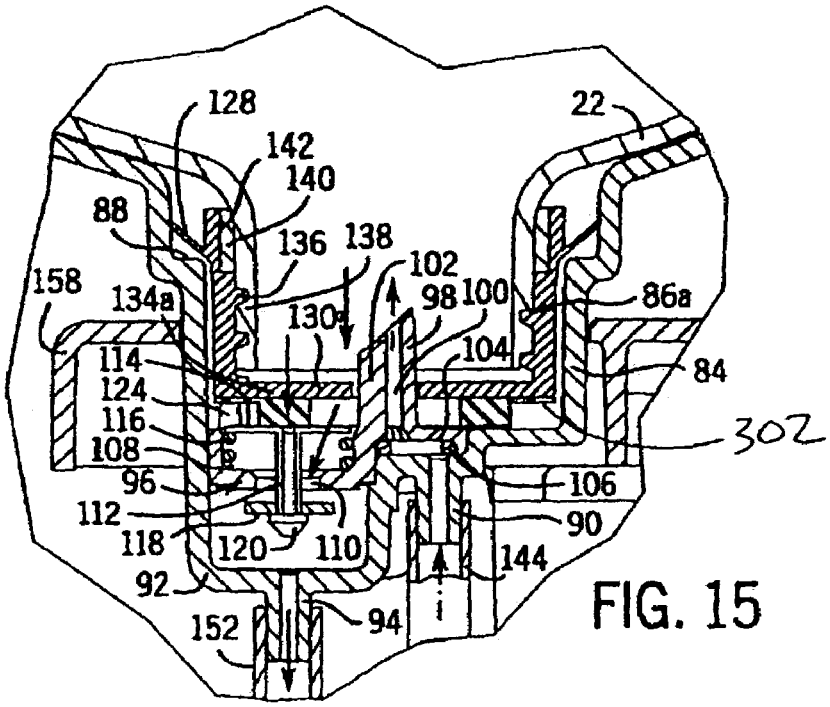
FIG. 15 is an enlarged view of the bottle-tray interface with the bottle seating in the tray and a discharge valve open, the bottle having the embodiment of the bottle cap with the adapter as shown in FIG. 14.
Figure 16:
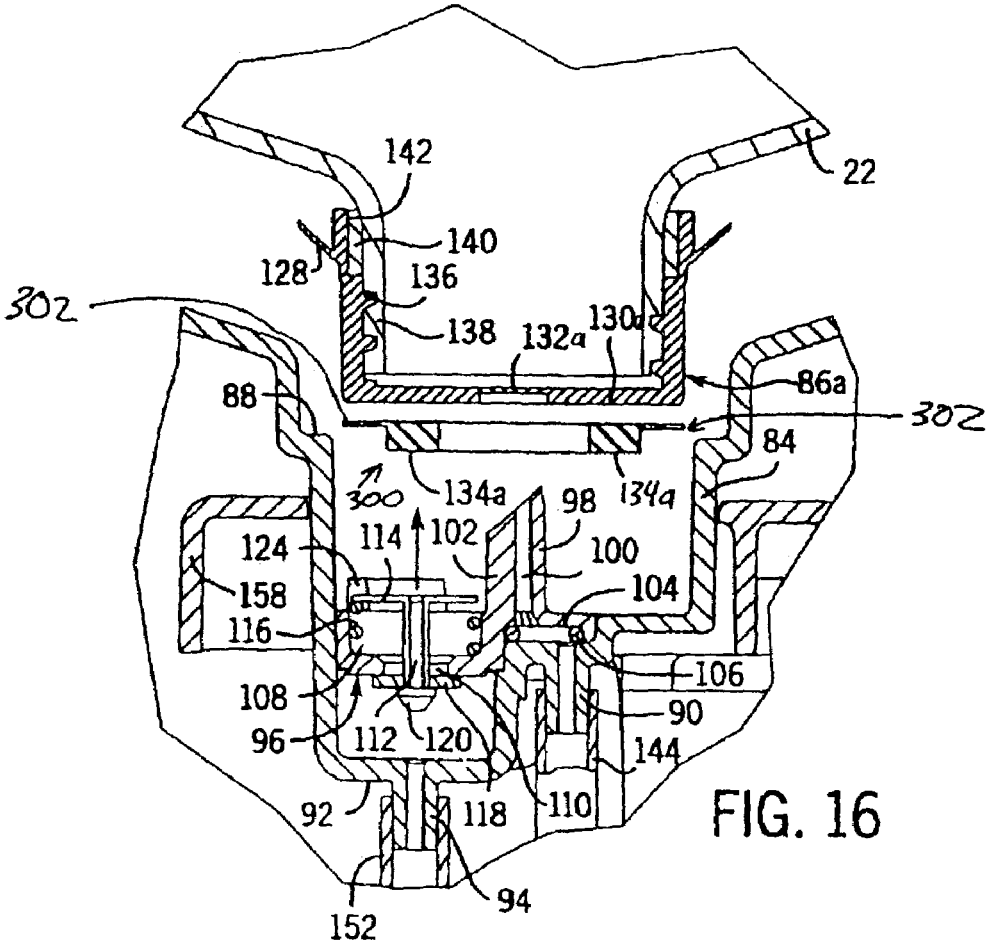
FIG. 16 is a view similar to FIG. 15, although with the bottle and adapter unseated from the tray and the discharge valve closed.

What has been described thus far with respect to FIGS. 1–13 is one of our automated sprayers in order to provide context for the use of the present invention. FIGS. 14–16 depict a first embodiment of the invention claimed herein. A flat top cap 86*a* is provided with a bottle 22. An adapter 300 is employed between the bottle cap and tray 56 to bridge the action of loading the bottle into the tray and the opening of the discharge orifice. Other aspects of this embodiment are the same as those described in FIGS. 1–13 above.

In this FIG. 14 embodiment, bottle cap 86*a* has a generally flat transverse outer surface 130*a* with a recessed thinned area 132*a* at its center. Adapter 300 has a flat ring 302 with an opening in the middle and a ring 134*a* protruding from the ring 302 but with a smaller outer circle. The ring 302 of the adapter 300 may optionally have the same serrated periphery 306 as the bottle cap 86*a*, and the outer circles of the ring 302 and the bottle cap 86*a*, including the serrated peripheries, typically have the same diameter.

When the bottle 22 is seated in the tray 56, piercing post 98 will go through the opening in the middle of the adapter 300 and puncture the cap 86*a* in the thinned area 132*a* to permit discharge of the cleanser and venting of the bottle. Meanwhile, the bottle cap 86*a* presses against the ring 302 of the adapter 300 so that the ring 134*a* of the adapter, which is located to contact plunger 114, pushes the valve downward to unseat gasket 118 from valve plate 96 and open the discharge orifice. The ring 302 of the adapter 300 rests on the stand-offs 124 to space the punctured area from the floor of the well 84.

Figure 17:
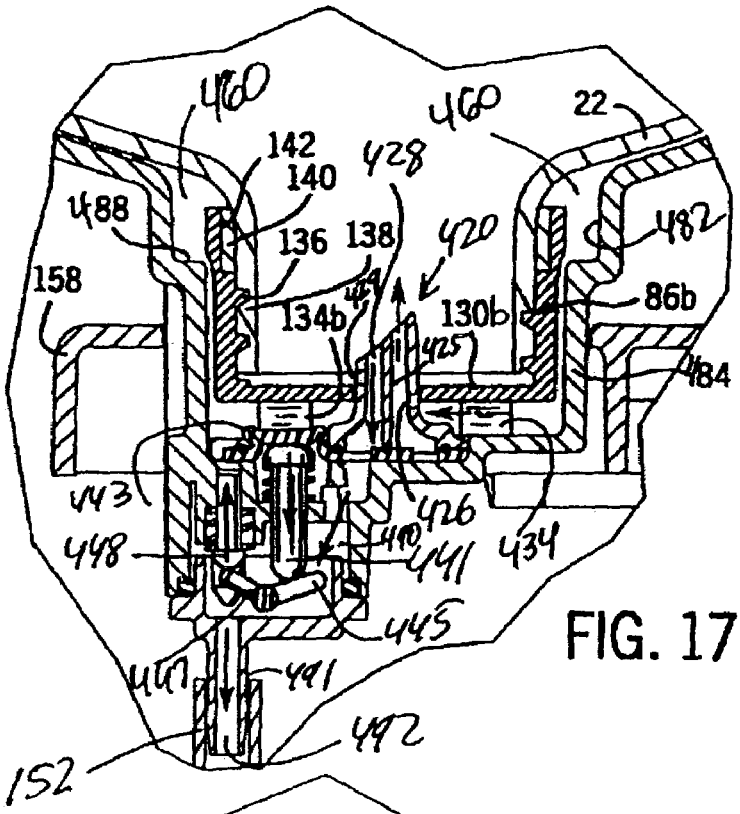
FIG. 17 is a view similar to FIG. 15, but of a second embodiment of the dispenser.
Figure 18:
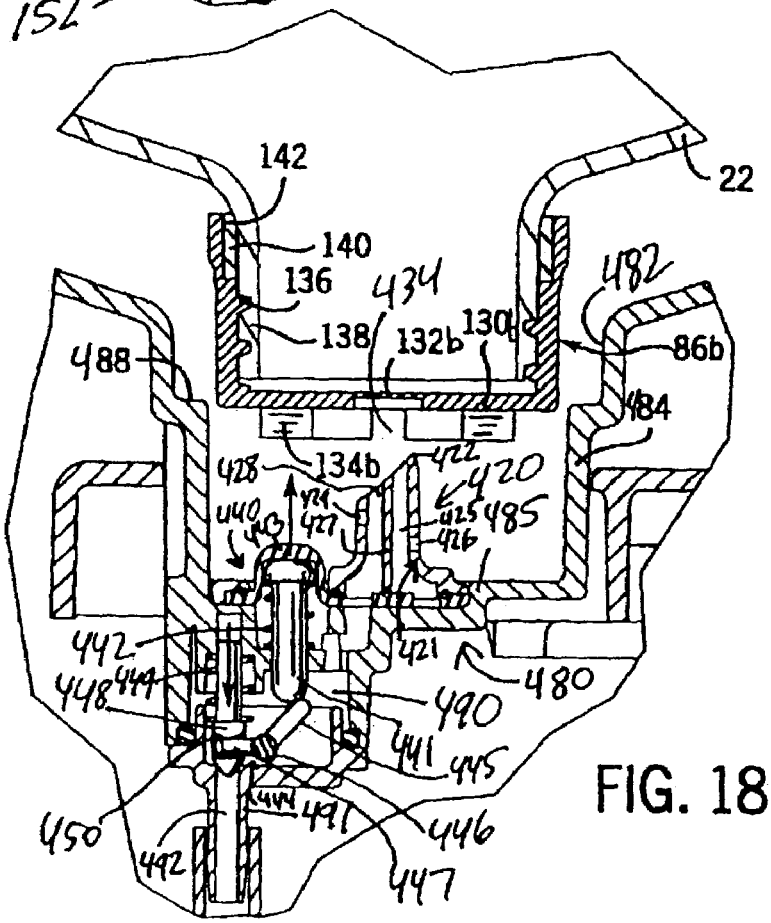
FIG. 18 is a view similar to FIG. 17 although with the bottle unseated from the tray and the discharge valve closed.

Turning now to FIGS. 17–19, there are shown alternative embodiments of a cap and the bottle-tray interface that may used to deliver cleanser from the bottle 22 to the tube 152 of the dispenser line 154 that extends to the inlet barb 156 of the pump 28 as described above. FIGS. 17–19 provide the context for the use of another embodiment of the present invention. In FIGS. 17–19, the cap 86*b* is as described above with reference to FIGS. 8–11 except that the cap 86*b* has four equally spaced segmented ridges 134*b* extending to a plane spaced from the surface 130*b*. The segmented ridges 134*b* are separated by slots 434. The segmented ridges 134*b* are located to contact a valve actuator to deliver cleanser from the bottle 22 to the first tube 152 of the dispenser line 154 that extends to the inlet barb 156 of the pump 28 as described below.

Referring now to FIG. 18, the alternative embodiment of a bottle-tray interface is shown just before the bottle 22 is placed in the reservoir tray. The reservoir tray has a well 480 including a circular upper section 484 with a floor 485 and a circular lower chamber 490 extending downwardly from a portion of the floor 485. A spout 491 extends downwardly from the lower chamber 490 and defines an outlet orifice 492.

A circular piercing post 420 extends upwardly from the floor 485 of the circular upper section 484 of the well 480. The piercing post 420 has an outer wall 421, and an inner wall 427 that defines an air vent path 425 and a cleanser conduit 428 in the piercing post 420. The cleanser conduit 428 provides a fluid flow path to the lower chamber 490 of the well 480. An air hole 426 passes through the outer wall 421 into the air vent path 425, and an opening 429 passes through the outer wall 421 into the cleanser conduit 428. The piercing post terminates in an obliquely truncated upper end 422 to facilitate puncturing the cap 86*b* in the thinned area 132*b* to permit discharge of the cleanser.

The lower chamber 490 of the well 480 contains a valve 438 that controls cleanser flow from the bottle 22 as will be described below. The valve 438 includes a valve actuator 440 and a valve stem 448. The valve actuator 440 includes a plunger 441, a valve cover 443 and a rocker 444. The plunger 441 is biased in the upward direction against the valve cover 443 by a spring 442 as shown in FIG. 18. The rocker 444 includes a pivot pin 446, an upper arm 445 and a lower forked arm 447. The forked arm 447 is seated in a groove 450 in the valve stem 448. A spring 449 biases the valve stem 448 against the entry to the outlet orifice 492 as shown by the arrow in FIG. 18. By spring-biasing the valve stem 448 into a normally closed seated position that seals the outlet orifice 492 of the lower chamber 490 of the well 480, any downward pressure exerted on the valve stem 448 (such as sucking by the pump 28) merely keeps the valve stem 448 seated (absent downward movement of the plunger 441 as described below).

Turning now to FIG. 17, the alternative embodiment of a bottle-tray interface is shown after the bottle 22 has been placed in the reservoir tray. When the bottle 22 is placed in the tray, at least a portion of one or more of the segmented ridges 134*b* of the cap 86*b* contacts the valve cover 433 thereby moving the plunger 441 downward in the direction shown in FIG. 17. The slots 434 between the segmented ridges 134*b* of the cap 86*b* have a width smaller than the diameter of the plunger 441 to insure movement of the plunger 441. When the plunger 441 moves downward, the upper arm 445 of the rocker 444 pivots the lower forked arm 447 in an upward direction thereby moving the valve stem 448 in the upward direction shown in FIG. 17. This unseats the valve stem 448 from the entry to the outlet orifice 492 as shown in FIG. 17. A cleanser flow path is then created from the bottle 22, through the cleanser conduit 428 of the piercing post 420, into the lower-chamber 490 of the well 480, through the outlet orifice 492, and into the first tube 152 of the dispenser line 154 that extends to the inlet barb 156 of the pump 28 as described above. Delivery of the cleanser from the spray nozzle 202 then occurs using the mechanisms, circuits, and processes described above.

Still referring to FIG. 17, when the bottle 22 is placed in the tray, an air passage 460 is created between the bottle 22 and an inner surface 482 of the well 480. An air flow path is thereby created from the air passage 460, through the slots 434 (best shown in FIG. 19) between the segmented ridges 134*b* of the cap 86*b*, through the air hole 426 in the outer wall 421 of the piecing post 420, through the air vent path 425 of the piercing post 420, and into the bottle 22.

The arrangement of FIGS. 17–19 also provides a no-mess means of opening and inserting the bottle and also further inhibits uses of improper cleanser containers. It does this for several reasons. First, if a conventional bottle and cap were inserted into the tray, the piercing post 420 would not puncture a conventional cap lacking the weakened area. Even if the cap was removed so that the mouth was opened, the sprayer still would not operate because the valve actuator 440 is located radially inward of the place where a conventional thin-walled bottle mouth would normally extend so that the valve would not be opened.

In addition, the floor 485 of the well may also include arcuate upwardly extending ribs (such as arcuate stand-offs 124 in FIG. 11) of a thickness or spaced inward sufficiently such that bottles with a narrower neck cannot contact the valve while a cap with narrow segmented ridges can contact the valve by way of thin, high segmented ridges. Also, while the cap 86*b* has conventional internal threads 136 at its upper end that mate with threads 138 on the mouth of the bottle, and it also has a ring of one-way ratchet teeth 140 that engage corresponding ratchet teeth 142 on the bottle as in FIG. 13. The ratchets allow the cap to be turned in a tightening direction but resist untightening rotation to prevent non-destructive removal of the cap and thus refilling of the bottle.

Figure 21:
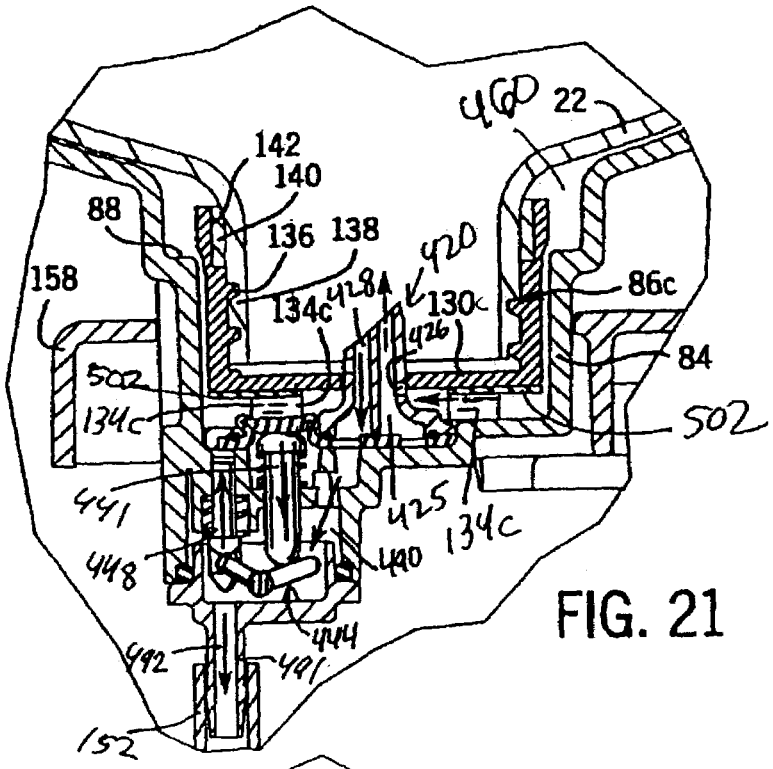
FIG. 21 is a view similar to FIG. 17, but with the FIG. 20 adapter.
Figure 22:
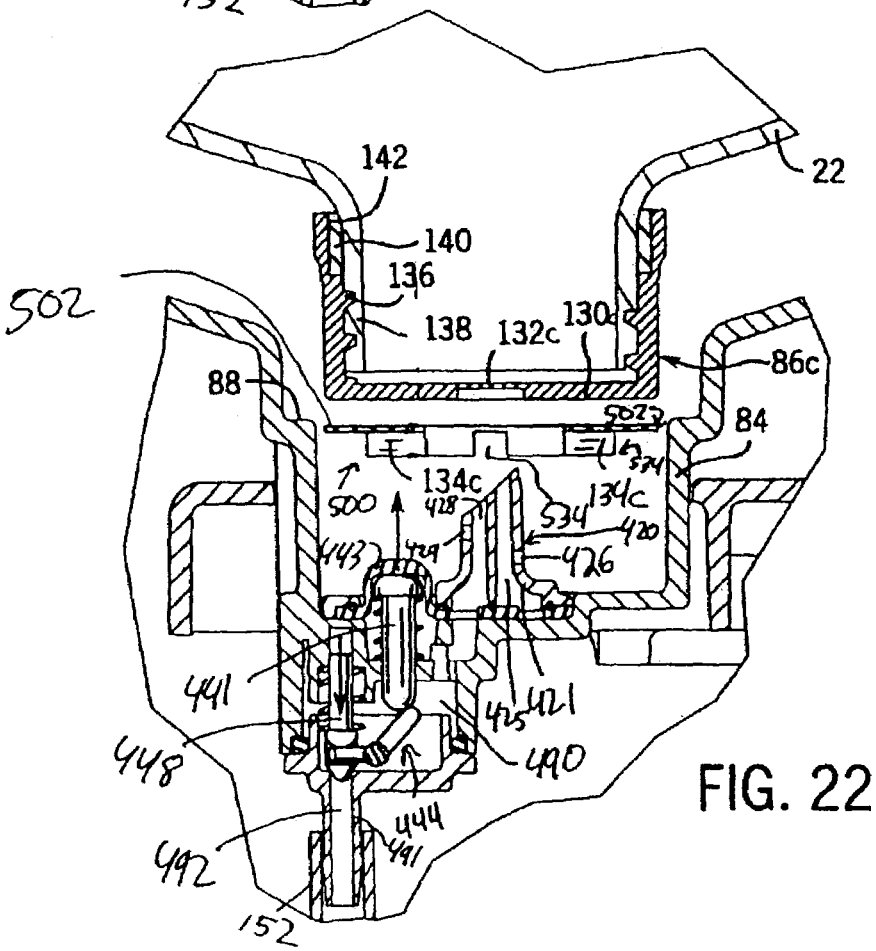
FIG. 22 is a view similar to FIG. 21 although with the bottle and adapter unseated from the tray and the discharge valve closed.

What has been described with respect to FIGS. 17–19 provides context for the use of another embodiment of the present invention. FIGS. 20–22 depict another embodiment of the invention claimed herein. A flat top cap 86*c* is provided for the bottle 22 and an adapter 500 is employed between the bottle cap 86*c* and tray 56 to bridge the action of loading the bottle into the tray and the opening of the discharge orifice. Other aspects of this embodiment are the same as those described in FIGS. 17–19 above. In this embodiment, bottle cap 86*c* has a generally flat transverse outer surface 130*c* with a recessed thinned area 132*c* at its center. Adapter 500 has a flat ring 502 with an opening in the middle and four segmented annular ridges 134*c* protruding from the ring 502. The ring 502 of the adapter 500 may optionally have the same serrated periphery 506 as the bottle cap 86*c* and the outer circles of the ring 502 and the bottle cap 86*c*, including the serrated peripheries, typically have the same diameter.

When the bottle 22 is seated in the tray 56, piercing post 420 will go through the opening in the middle of the adapter 500 and puncture the cap 86*c* in the thinned area 132*c* to permit discharge of the cleanser and venting of the bottle. Meanwhile, the bottle cap 86*c* presses against the ring 502 of the adapter 500 so that at least a portion of one of the segmented ridges 134*c*, which is located to contact valve cover 443, pushes the valve actuator 440 downward to unseat valve stem 448 from outlet orifice 492 and open the outlet orifice 492.

Figure 23:
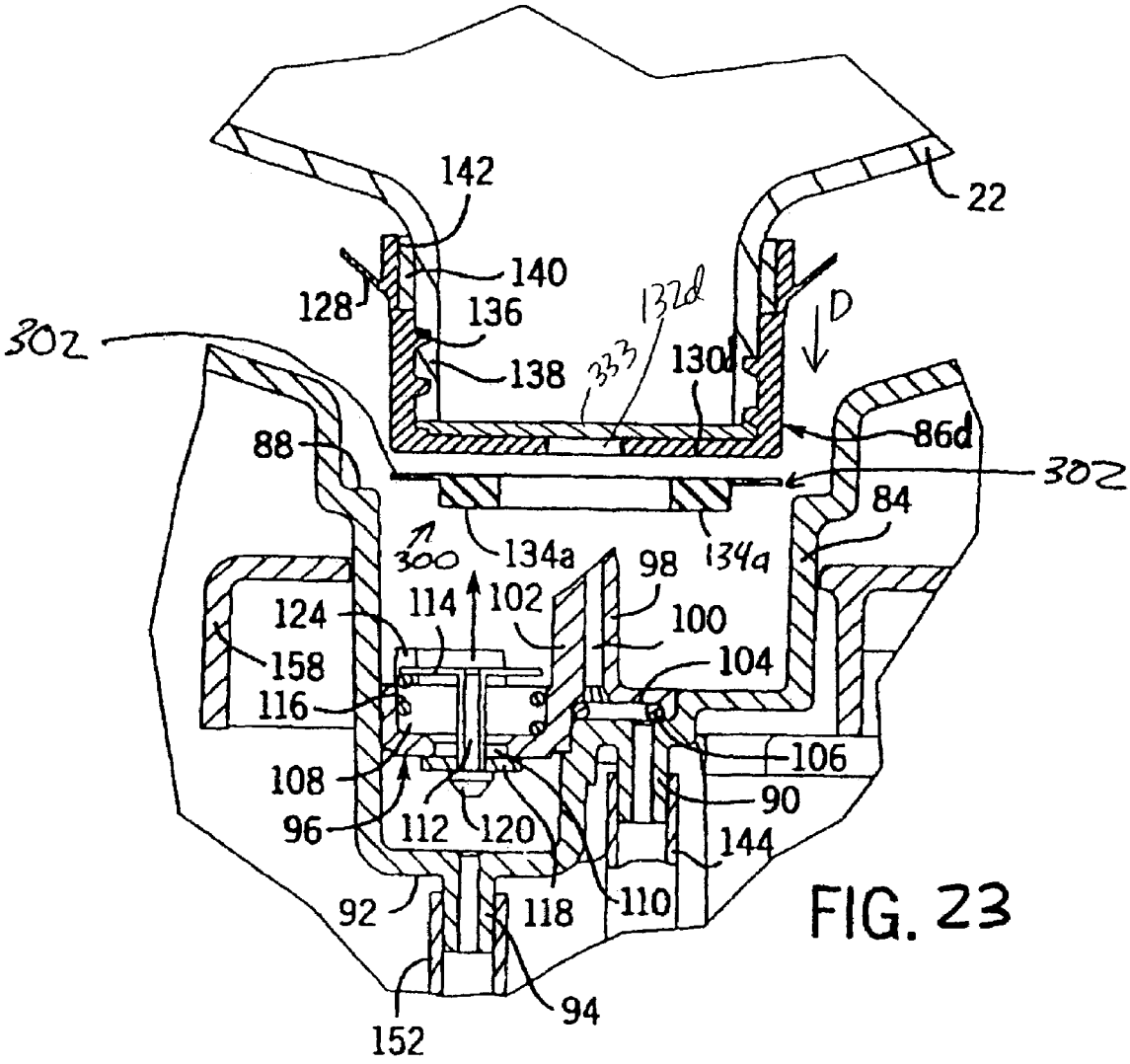
FIG. 23 is a view similar to FIG. 16 although with a bottle having an alternative cap and a cap liner.

FIG. 23 depicts yet another embodiment of the invention claimed herein. A flat top cap 86*d* and a cap liner 333 are provided with a bottle 22. Other aspects of this embodiment are the same as those described in FIGS. 1–16 above. In this embodiment, bottle cap 86*d* has a generally flat transverse outer surface 130*d* with a central hole 132*d* at its center. The cap liner 333, which may be any piercable material such as a closed cell polyethylene foam or foil, seals the opening of the bottle 22 and also seals the central hole 132*d* of the bottle cap 86*d*. In one version of the invention, the cap liner 333 is sealed to the bottle 22 by way of conventional methods such as ultrasonic welding, radio frequency welding or heat sealing. In another version of the invention, the cap liner 333 is positioned between the bottle 22 and the bottle cap 86*d* but is not attached to the bottle 22 or the bottle cap 86*d*.

Still referring to FIG. 23, when the bottle 22 is seated in the tray 56 by movement in direction 'D', piercing post 98 will go through the opening in the middle of the adapter 300, through the central hole 132*d* of the bottle cap 86*d*, and puncture the cap liner 333 to permit discharge of the cleanser and venting of the bottle. The cap liner 333 can provide a seal around the piercing post 98. Meanwhile, the bottle cap 86*d* presses against the ring 302 of the adapter 300 so that the ring 134*a* of the adapter, which is located to contact plunger 114, pushes the valve downward to unseat gasket 118 from valve plate 96 and open the discharge orifice.

Figure 24:
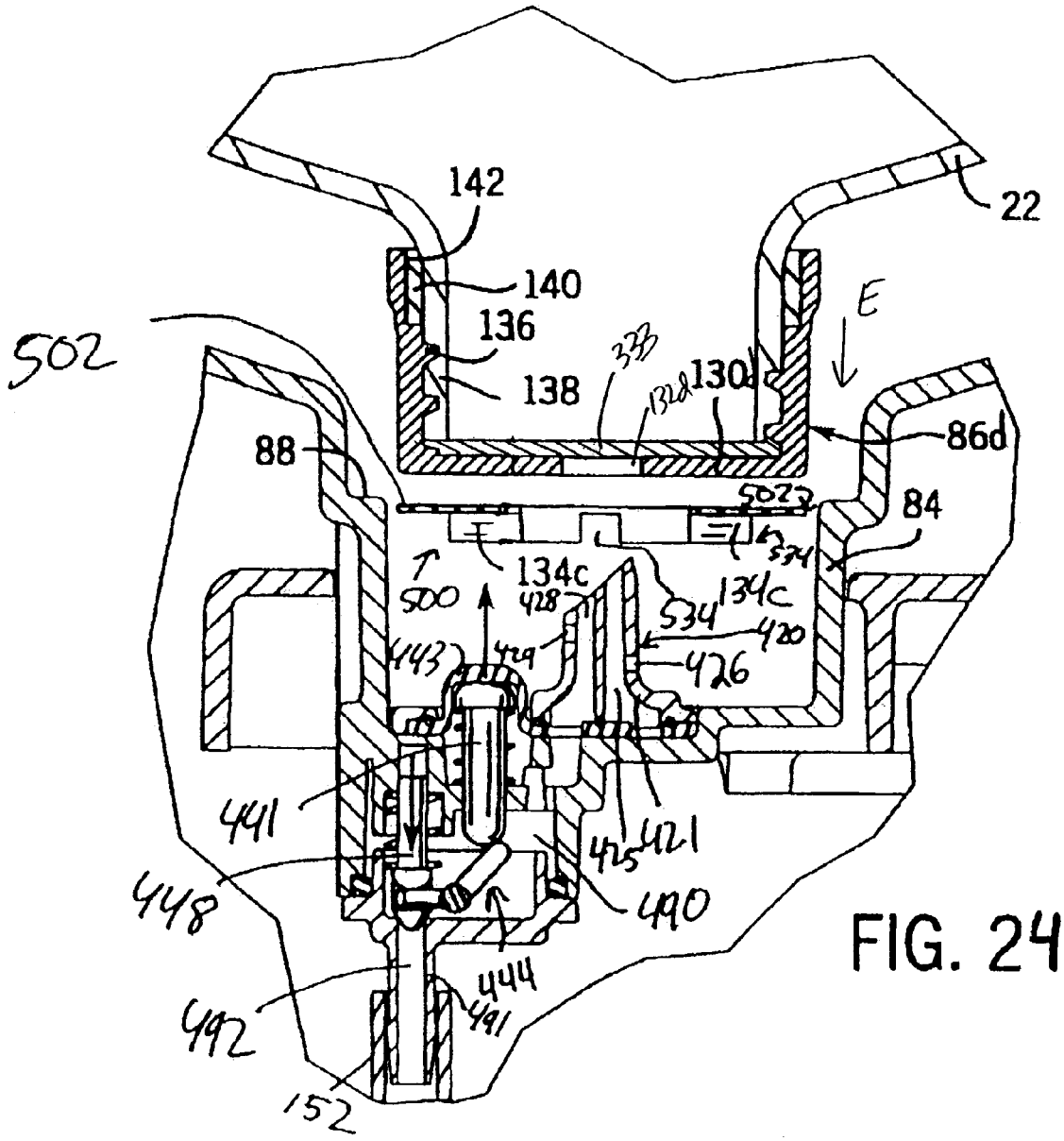
FIG. 24 is a view similar to FIG. 22 although with a bottle having an alternative cap and a cap liner.

FIG. 24 depicts yet another embodiment of the invention claimed herein. A flat top cap 86*d* and a cap liner 333 are provided with a bottle 22 as described in FIG. 23 above. Other aspects of this embodiment are the same as those described in FIGS. 17–22 above. In this embodiment, when the bottle 22 is seated in the tray 56 by movement in direction 'E', the piercing post 420 will go through the opening in the middle of the adapter 500, through the central hole 132*d* of the bottle cap 86*d*, and puncture the cap liner 333 to permit discharge of the cleanser and venting of the bottle. The cap liner 333 can provide a seal around the piercing post 420. Meanwhile, the bottle cap 86*d* presses against the ring 502 of the adapter 500 so that at least a portion of one of the segmented ridges 134*c*, which is located to contact valve cover 443, pushes the valve actuator 440 downward to unseat valve stem 448 from outlet orifice 492 and open the outlet orifice 492.

Figure 25:
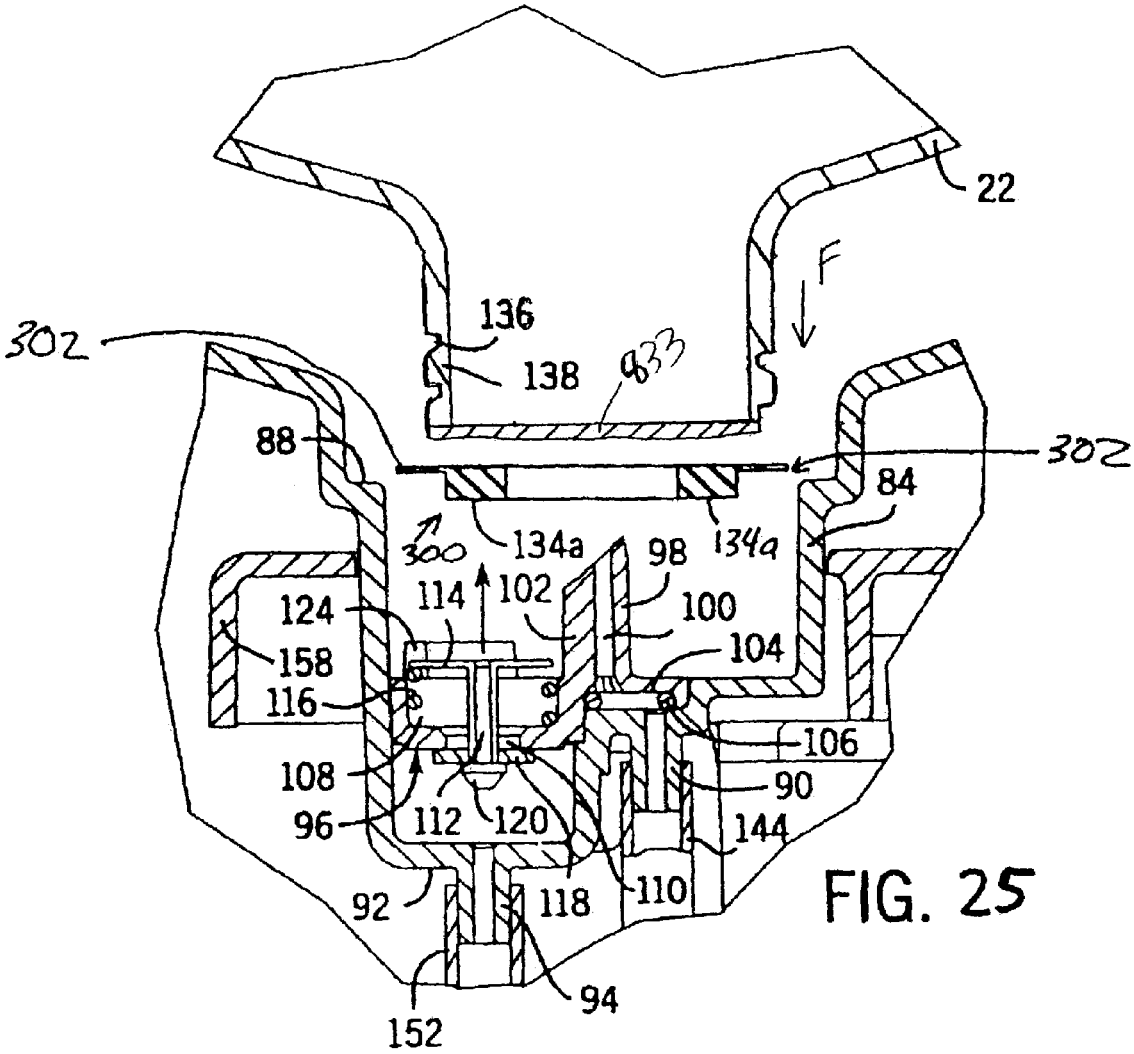
FIG. 25 is a view similar to FIG. 16 although with a bottle having a removable cap and a closure seal.

FIG. 25 depicts yet another embodiment of the invention claimed herein. A cap closure 833 is provided with a bottle 22. Other aspects of this embodiment are the same as those described in FIGS. 1–16 above. The cap closure 833, which may be any piercable material such as a closed cell polyethylene foam or foil, seals the opening of the bottle 22. The cap closure 833 may be sealed to the bottle 22 by way of conventional methods such as ultrasonic welding, radio frequency welding or heat sealing. Optionally, the bottle 22 may be provided with a removable cap (similar to cap 86*d* with no central hole 132*d*) for shipping purposes. When the bottle 22 is seated in the tray 56 by movement in direction 'F', piercing post 98 will puncture the cap closure 833 to permit discharge of the cleanser and venting of the bottle. The cap closure 833 can provide a seal around the piercing post 98. Meanwhile, the cap closure 833 presses against the ring 302 of the adapter 300 so that the ring 134*a* of the adapter 300, which is located to contact plunger 114, pushes the valve downward to unseat gasket 118 from valve plate 96 and open the discharge orifice.

Figure 26:
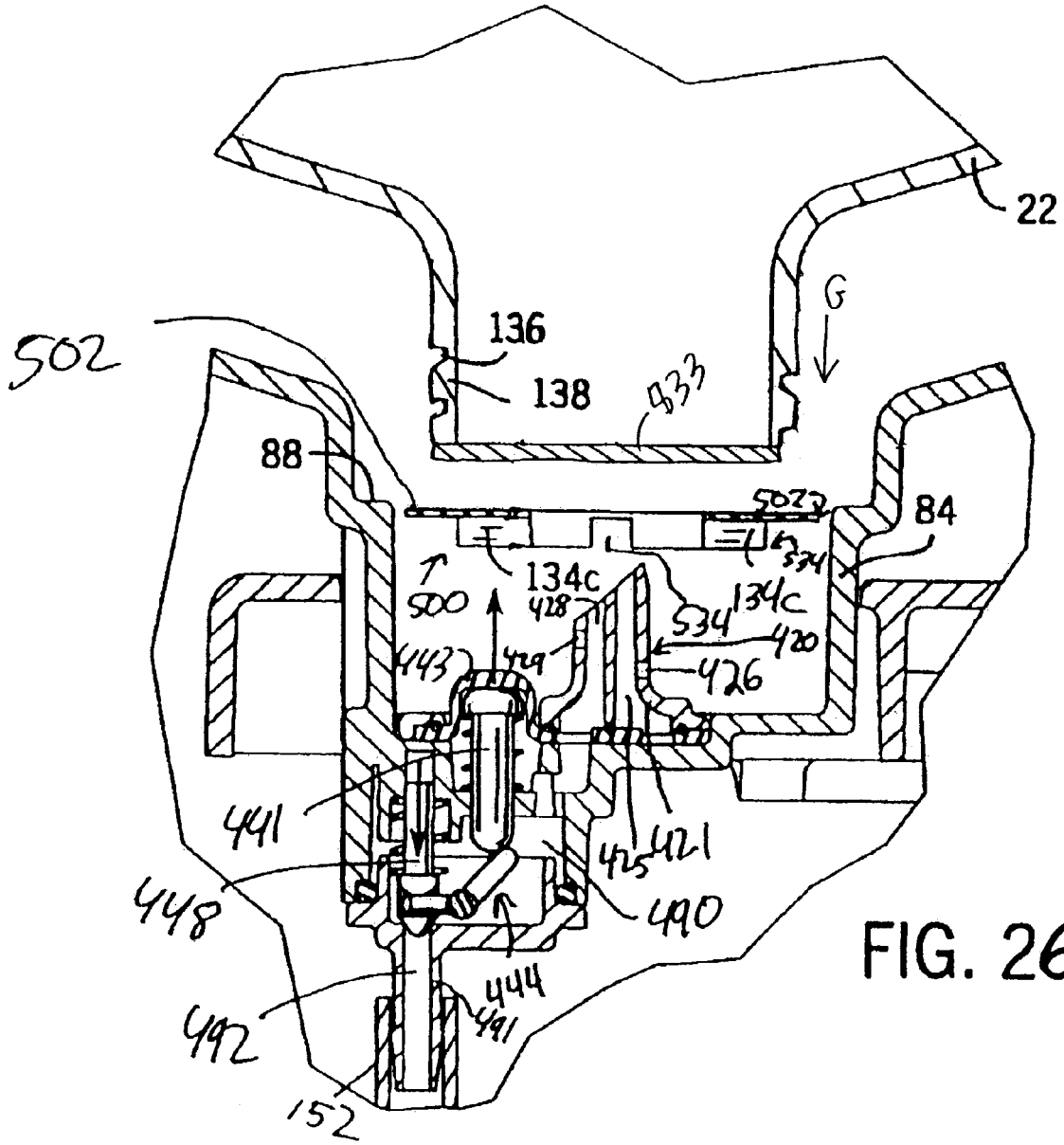
FIG. 26 is a view similar to FIG. 22 although with a bottle having a removable cap and a closure seal.

FIG. 26 depicts yet another embodiment of the invention claimed herein. A cap closure 833 provided with a bottle 22 as described in FIG. 25 above. Other aspects of this embodiment are the same as those described in FIGS. 17–22 above. The cap closure 833, which may be any piercable material such as a closed cell polyethylene foam or foil, seals the opening of the bottle 22. Optionally, the bottle 22 may be provided with a removable cap (similar to cap 86*d* with no central hole 132*d*) for shipping purposes. In this embodiment, when the bottle 22 is seated in the tray 56 by movement in direction 'G', the piercing post 420 will puncture the cap closure 833 to permit discharge of the cleanser and venting of the bottle. The cap closure 833 can provide a seal around the piercing post 420. Meanwhile, the cap closure 833 presses against the ring 502 of the adapter 500 so that at least a portion of one of the segmented ridges 134*c*, which is located to contact valve cover 443, pushes the valve actuator 440 downward to unseat valve stem 448 from outlet orifice 492 and open the outlet orifice 492.

What has been described with respect to FIGS. 1–13 also provides context for the use of another embodiment of the claimed invention as depicted in FIGS. 27 and 28. A flat top cap 86*d* is provided with a bottle 22. An adapter 800 is employed between the bottle cap and tray 56 to bridge the action of loading the bottle into the tray and the opening of the discharge orifice. Other aspects of this embodiment are the same as those described in FIGS. 1–13 and 23 above. In this FIG. 27 embodiment, bottle cap 86*d* has a generally flat transverse outer surface 130*d* with a hole 132*d* at its center. Adapter 800 is a flat annular ring with an opening in the middle and has a square or rectangular vertical cross-section. When the bottle 22 is seated in the tray 56 by movement in direction 'I', piercing post 98 will go through the opening in the middle of the adapter 800, through the central hole 132*d* of the bottle cap 86*d*, and puncture the cap liner 333 to permit discharge of the cleanser and venting of the bottle. The cap liner 333 can provide a seal around the piercing post 98. Meanwhile, the bottle cap 86*d* presses against the adapter 800 so that the adapter 800, which is located to contact plunger 114, pushes the valve downward to unseat gasket 118 from valve plate 96 and open the discharge orifice. The adapter 800 rests on the floor of the well inward of the stand-offs 124. The vertical height of the adapter 800 is preferably greater than the height of the stand-offs 124 above the floor of the well 84. However, the vertical height of the adapter 800 must not be so great as to prevent the piercing post 98 from puncturing the cap liner 333 to permit discharge of the cleanser and venting of the bottle.

What has been described with respect to FIGS. 1–13 also provides context for the use of another embodiment of the claimed invention as depicted in FIGS. 27 and 29. A cap closure 833 is provided with a bottle 22. An adapter 800 is employed between the bottle cap and tray 56 to bridge the action of loading the bottle into the tray and the opening of the discharge orifice. Other aspects of this embodiment are the same as those described in FIGS. 1–13 and 25 above. The cap closure 833, which may be any piercable material such as a closed cell polyethylene foam or foil, seals the opening of the bottle 22. Optionally, the bottle 22 may be provided with a removable cap (similar to cap 86*d* with no central hole 132*d*) for shipping purposes. When the bottle 22 is seated in the tray 56 by movement in direction 'J', piercing post 98 will puncture the cap closure 833 to permit discharge of the cleanser and venting of the bottle. The cap closure 833 can provide a seal around the piercing post 98. Meanwhile, the cap closure 833 presses against the adapter 800 so that the adapter 800, which is located to contact plunger 114, pushes the valve downward to unseat gasket 118 from valve plate 96 and open the discharge orifice. The adapter 800 rests on the floor of the well inward of the stand-offs 124. The vertical height of the adapter 800 is preferably greater than the height of the stand-offs 124 above the floor of the well 84. However, the vertical height of the adapter 800 must not be so great as to prevent the piercing post 98 from puncturing the cap closure 833 to permit discharge of the cleanser and venting of the bottle.

The invention thus facilitates the use bottles with differing bottle caps in an automated cleansing sprayer of the type having a reservoir tray with an upwardly extending well for supporting a bottle in an inverted orientation. All that is required to replenish the cleanser is simply to remove the old bottle, turn a new bottle upside down, load an adapter according to the invention into the tray and then load the new bottle into the tray. The sprayer automatically meters out the proper volume of cleanser for the spray cycle.

It should also be noted that the inventive aspects of the invention could be used to dispense a cleaning or disinfecting solution in applications other than a tub/shower surround. In this regard, U.S. Pat. No. 4,183,105 depicts how one type of automated cleansing equipment could be installed to clean the bowl. Such a structure should be considered to be an "enclosure" for purposes of this application.

Preferred embodiments of the invention have been described in considerable detail above. Many modifications and variations to the preferred embodiments will be apparent to those skilled in the art, which will be within the spirit and scope of the invention. Therefore, the invention should not be limited to the described embodiments. To ascertain the full scope of the invention, reference should be made to the following claims.

INDUSTRIAL APPLICABILITY

The invention provides a bottle adapter for use with a bottle for an automated sprayer for spraying a liquid cleanser on the walls of an enclosure such as a shower and the like.

What is claimed is:

1. A liquid refill kit for an automated cleansing sprayer, the sprayer being of the type having a reservoir tray having an upwardly extending well for supporting a bottle in an inverted orientation, wherein the well has a spring-loaded outlet valve, the refill kit comprising:

a bottle that is suitable to contain a liquid and has a cap closing an end of the bottle, the cap being formed with a central piercable surface; and an adapter having a central hole and being suitable for being situated between the bottle cap and a bottom wall of the upwardly extending well in the sprayer for supporting the bottle, the adapter being configured such that if the cap and adapter are installed in the well, movement of the cap relative to the well can result in movement of the adapter which in turn can result in movement of the outlet valve that controls the opening and closing of the valve.

2. The kit of claim 1, wherein the cap has a radially extending web to form a seal against a side of the well.

3. The kit of claim 1, wherein the adapter has a radial air passageway and a central air passageway to allow air outside the bottle to pass-through the adapter and the cap and enter into the bottle when a suitable opening is created in the cap.

4. An adapter for the kit of claim 1, wherein the adapter is a ring having a central hole and a plurality of projecting arc segments around the hole.

5. A dispenser for dispensing a liquid, the dispenser comprising:

a bottle suitable to contain the liquid;

a reservoir tray having an upwardly extending well for supporting the bottle in an inverted orientation;

a cap closing an end of the bottle; and an adapter situated between the cap and a bottom of the well, wherein the well has a spring-loaded outlet valve that permits outflow from the well when movement of the cap relative to the well results in movement of the adapter causing movement of the outlet valve.

6. The dispenser of claim 5, wherein the cap has a radially extending web to form a seal against a side of the well.

7. The dispenser of claim 5, wherein the adapter has a radial air passageway and a central air passageway to allow air outside the bottle to pass through the adapter and the cap and enter into the bottle when a suitable opening is created in the cap.

8. A liquid refill kit for an automated cleansing sprayer, the sprayer being of the type having a reservoir tray having an upwardly extending well for supporting a bottle in an inverted orientation, wherein the well has a spring-loaded outlet valve, the refill kit comprising:

a bottle that is suitable to contain a liquid and has a cap installed on an end of the bottle, the cap being formed with a central hole, the central hole being sealed with a piercable liner; and an adapter having a central hole and being suitable for being situated between the bottle cap and a bottom wall of the upwardly extending well in the sprayer for supporting the bottle, the adapter being configured such that if the cap and adapter are installed in the well, movement of the cap relative to the well can result in movement of the adapter which in turn can result in movement of the outlet valve that controls the opening and closing of the valve.

9. The kit of claim 8, wherein the liner is positioned between the cap and the bottle.

10. The kit of claim 8, wherein the adapter has a radial air passageway and a central air passageway to allow air outside the bottle to pass through the adapter and the cap and enter into the bottle when a suitable opening is created in the cap.

11. An adapter for the kit of claim 8, wherein the adapter is a ring having a central hole and a plurality of projecting arc segments around the hole.

12. A dispenser for dispensing a liquid, the dispenser comprising:

a bottle suitable to contain the liquid;

a reservoir tray having an upwardly extending well for supporting the bottle in an inverted orientation;

a cap installed on an end of the bottle, the cap being formed with a central hole sealed with a piercable liner prior to placement of the bottle in the tray; and an adapter situated between the cap and a bottom of the well, wherein the well has a spring-loaded outlet valve that permits outflow from the well when movement of the cap relative to the well results in movement of the adapter causing movement of the outlet valve.

13. The dispenser of claim 12, wherein the adapter has a radial air passageway and a central air passageway to allow air outside the bottle to pass through the adapter and the cap and enter into the bottle when a suitable opening is created in the cap.

14. A liquid refill kit for an automated cleansing sprayer, the sprayer being of the type having a reservoir tray having an upwardly extending well for supporting a bottle in an inverted orientation, wherein the well has a spring-loaded outlet valve, the refill kit comprising:

a bottle that is suitable to contain a liquid and has a piercable closure sealing an end of the bottle; and an adapter having a central hole and being suitable for being situated between the closure and a bottom wall of the upwardly extending well in the sprayer for supporting the bottle;

the adapter being configured such that if the bottle and adapter are installed in the well, movement of the closure relative to the well can result in movement of the adapter which in turn can result in movement of the outlet valve that controls the opening and closing of the valve.

15. The kit of claim 14, wherein the closure comprises a closed cell foam.

16. The kit of claim 14, further comprising a cap installed on the end of the bottle, wherein the closure is positioned between the cap and the bottle before the bottle and the adapter are installed in the well, and the cap is suitable for being removed before the bottle and the adapter are installed in the well.

17. The kit of claim 14, wherein the adapter has a radial air passageway and a central air passageway to allow air outside the bottle to pass through the adapter and the cap and enter into the bottle when a suitable opening is created in the cap.

18. An adapter for the kit of claim 14, wherein the adapter is a ring having a central hole and a plurality of projecting arc segments around the hole.

19. A dispenser for dispensing a liquid, the dispenser comprising:

a bottle suitable to contain the liquid;

a reservoir tray having an upwardly extending well for supporting the bottle in an inverted orientation;

a piercable closure for sealing an end of the bottle before the bottle is installed in the well; and an adapter with a central hole, the adapter being situated between the closure and a bottom of the well, wherein the well has a spring-loaded outlet valve that permits outflow from the well when movement of the closure relative to the well results in movement of the adapter causing movement of the outlet valve.

20. The dispenser of claim 19, wherein the closure comprises a closed cell foam.

21. The dispenser of claim 19, wherein the adapter has a radial air passageway and a central air passageway to allow air outside the bottle to pass through the adapter and the cap and enter into the bottle when a suitable opening is created in the cap.

* * * * *